US012312051B2

(12) United States Patent
Jalala

(10) Patent No.: US 12,312,051 B2
(45) **Date of Patent: *May 27, 2025**

(54) BOAT STABILIZER WITH CONTROLLABLE PARASAIL

(71) Applicant: Farid Jalala, Anaheim, CA (US)

(72) Inventor: Farid Jalala, Anaheim, CA (US)

( * ) Notice: Subject to any disclaimer, the term of this patent is extended or adjusted under 35 U.S.C. 154(b) by 579 days.

This patent is subject to a terminal disclaimer.

(21) Appl. No.: 17/650,369

(22) Filed: Feb. 8, 2022

(65) Prior Publication Data

US 2022/0388612 A1 Dec. 8, 2022

Related U.S. Application Data

(63) Continuation-in-part of application No. 17/339,882, filed on Jun. 4, 2021, now Pat. No. 11,242,115.

(51) Int. Cl.

| | |
|---|---|
| ***B63B 39/06*** | (2006.01) |
| ***B63B 1/26*** | (2006.01) |
| ***B63B 1/28*** | (2006.01) |
| ***B63B 1/30*** | (2006.01) |
| ***B63B 35/00*** | (2020.01) |

(Continued)

(52) U.S. Cl.

CPC ..... *B63B 39/06* (2013.01); *B63B 39/062* (2013.01); *B63B 79/40* (2020.01); *B63H 8/10* (2020.02); *B63H 8/16* (2020.02); *B63H 9/069* (2020.02); *B63H 9/071* (2020.02); *B63H 9/072* (2020.02); *B63H 25/38* (2013.01); *B63B 1/26* (2013.01);

(Continued)

(58) Field of Classification Search

CPC ... B63H 8/10; B63H 8/12; B63H 8/14; B63H 8/16; B63H 9/069; B63H 9/071; B63H 9/072; B63B 2001/281; B63B 1/26; B63B 1/30; B63B 39/06; B63B 39/062

See application file for complete search history.

(56) References Cited

U.S. PATENT DOCUMENTS

| | | | |
|---|---|---|---|
| 2,584,347 A | 2/1952 | Hazard | |
| 3,150,626 A | 9/1964 | Irgens | |

(Continued)

FOREIGN PATENT DOCUMENTS

| | | | |
|---|---|---|---|
| FR | 2918345 A1 * | 1/2009 | ..... B63B 35/7979 |
| FR | 2978106 A1 * | 1/2013 | ..... B63B 9/08 |

(Continued)

*Primary Examiner* — Ajay Vasudeva

(74) *Attorney, Agent, or Firm* — CIONCA IP Law P.C.

(57) ABSTRACT

A boat stabilizer having an upper harness for attachment to a vessel, the upper harness having an assembly control system for controlling attached wing assemblies, each wing assembly having a wing attached to the assembly control system and a wing mount attached to the wing and the assembly control system. The boat stabilizer may be further comprised of a controllable parasail comprising a parasail canopy, a plurality of parasail cords attached the parasail canopy, a parasail mount attached to the upper harness and the parasail cords, a parasail control rudder attached to each parasail cords, and yaw and pitch controllers, both of which are attached to the parasail control rudder. The assembly control system is configured to work in conjunction with the controllable parasail to provide the desired balance of vertical lift and forward propulsion to the attached vessel, while also providing directional control to the attached vessel.

20 Claims, 20 Drawing Sheets

(51) Int. Cl.

| | |
|---|---|
| ***B63B 79/40*** | (2020.01) |
| ***B63H 8/10*** | (2020.01) |
| ***B63H 8/16*** | (2020.01) |
| ***B63H 9/069*** | (2020.01) |
| ***B63H 9/071*** | (2020.01) |
| ***B63H 9/072*** | (2020.01) |
| ***B63H 25/38*** | (2006.01) |

(52) U.S. Cl.
CPC ..... *B63B 2001/281* (2013.01); *B63B 1/30* (2013.01); *B63B 2035/009* (2013.01)

(56) References Cited

U.S. PATENT DOCUMENTS

| | | | | |
|---|---|---|---|---|
| 5,117,776 | A | 6/1992 | Thorpe | |
| 6,918,346 | B2 * | 7/2005 | Grenier | B63H 9/069 114/102.16 |
| 7,743,720 | B1 | 6/2010 | Salani | |
| 8,117,977 | B2 * | 2/2012 | Reusch | B63H 9/069 114/102.16 |
| 9,828,078 | B2 * | 11/2017 | Reiners | B63H 9/072 |
| 11,242,115 | B1 * | 2/2022 | Jalala | B63B 1/28 |
| 2005/0040291 | A1 * | 2/2005 | Hansel | B63H 8/18 244/155 A |

FOREIGN PATENT DOCUMENTS

| | | | | |
|---|---|---|---|---|
| GB | 2098950 | A * | 12/1982 | B63H 9/06 |
| WO | WO-2011076270 | A1 * | 6/2011 | B63H 9/0685 |
| WO | WO-2019151881 | A1 * | 8/2019 | B63H 9/069 |

* cited by examiner

BOAT STABILIZER WITH CONTROLLABLE PARASAIL

CROSS-REFERENCE TO RELATED APPLICATIONS

This application is a continuation-in-part and claims the benefit of U.S. Non-Provisional application Ser. No. 17/339,882, filed on Jun. 4, 2021, which is hereby incorporated by reference, to the extent that it is not conflicting with the present application.

BACKGROUND OF INVENTION

1. Field of the Invention

The invention relates generally to nautical equipment and specifically to a stabilization device for nautical vessels.

2. Description of the Related Art

Conventional nautical vessels ("boats") often experience an array of challenges during travel that affect their stability, efficiency, safety, passenger comfort, vessel longevity and thus their general viability as a means of travel in many environments. Turbulent waters and strong winds will often rock vessels, potentially violently, resulting in unsafe conditions that may capsize or damage the vessel. Even in less extreme conditions, the rocking of the vessel as a result of the wind or waves may result in seasickness for susceptible passengers. Additionally, the significant amount of drag exerted on the vessel's hull by the surrounding water during travel requires that a significant amount of force be used to propel it, resulting in slow speeds and short travel distances, as well as lower fuel efficiencies on powered vessels. Due to these shortcomings, several technologies have emerged in order to provide potential solutions.

Incorporation of hydrofoils into vessels to provide additional lift during travel may help alleviate some of the issues present for some conventional nautical vessels, but this technology has its limitations. Hydrofoils are typically incorporated as a permanent, non-adjustable part of the vessel, limiting the application of these vessels, especially in shallow waters or where subsurface vertical clearance is a concern due to aquatic flora, fauna or other hazards. The lift provided by a non-adjustable hydrofoil may not be helpful or even safe in instances where the effects of strong winds or turbulent waters may be exacerbated by the supplied lift force. Additionally, the unibody design of some hydrofoils can make replacement and maintenance of the device costly and difficult.

While usage of a standard sail attached to a vessel may result in the vessel being rocked back and forth, and potentially capsized, a parasail may provide propulsion to vessel without rocking it as severely. A conventional parasail may be employed on a vessel in order to take advantage of higher elevation air currents to propel the vessel. In addition to providing forward propulsion, said parasail may also exert a lift force on said vessel. This lift force, if not properly accommodated for may result in the vessel being lifted uncontrollably out of the water and into the air, creating a potentially hazardous situation. Therefore, there is a need to provide a boat stabilizer system that provide solutions to the issues and limitations detailed above.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, a boat stabilizer is provided, the boat stabilizer comprising: an upper harness having: a body and; an assembly control system having two wing angle controllers and four orientation locks; four wing assemblies attached to the body, each wing assembly comprising: a wing secured to a corresponding wing angle controller; a wing mount attached to the wing and a corresponding orientation lock, wherein the assembly control system is configured to adjust a pitch angle of each of the wings and to rotate each of the wing assemblies in and out of water; and a controllable parasail comprising: a parasail canopy; a plurality of parasail cords secured to the parasail canopy; a mount line secured to the plurality of parasail cords; a parasail mount secured to the mount line and the upper harness; a parasail control rudder pivotally secured to the parasail cords, the parasail control rudder comprising: a first adjustment panel having a tip end, a pivoting end, two opposite side ends and a yaw pivot screw attached to each opposite side end, wherein each yaw pivot screw is configured to be nested within a yaw screw port within a corresponding parasail cord and the first adjustment panel is configured to be rotated on a yaw rotational axis; a second adjustment panel having a tip end, a pivoting end, two opposite side ends and a pitch pivot screw attached to each opposite side end, wherein each pitch pivot screw is configured to be nested within a pitch screw port in a corresponding parasail cord and the second adjustment panel is configured to be rotated on a pitch rotational axis; wherein the pitch rotational axis and yaw rotational axis are perpendicular to each other; a yaw controller secured to the upper harness; a pitch controller secured to the upper harness; a yaw cable secured to the yaw controller and the tip end of the first adjustment panel, wherein the yaw cable is nested within cable slots within corresponding parasail cords and the yaw controller is configured to adjust the yaw cable to selectively rotate the first adjustment panel on the yaw rotational axis; and a pitch cable secured to the pitch controller and the tip end of the second adjustment panel, wherein the pitch cable is nested within cable slots within corresponding parasail cords and the pitch controller is configured to adjust the pitch cable to selectively rotate the second adjustment panel on the pitch rotational axis. One advantage is that as the boat travels forward, a lift force will be applied on the wings and thus, the attached boat, raising it out of the water, resulting in a reduced turbulence from being risen above some waves, preventing or lessening seasickness in passengers. Another advantage of the supplied lift is that it may increase speed, fuel milage and/or travel distance of the boat as a result of reducing the amount of drag experienced by the boat by the surrounding water during travel. Another advantage is that boat longevity may be increased as a result of decreased impact force and frequency from waves as a result of the supplied lift. Another advantage is that the wing angles may be adjusted to keep the boat steady and upright during strong winds, turbulent waters or other hazardous conditions. Another advantage is that this technology may be applied to a boat with only minor modifications and may be deployed or withdrawn at will. Another advantage is that the controllable parasail may be used to provide additional lift and propulsion to the attached boat, as well as steering capabilities in the form of directional control enabled by the yaw controller. Another advantage is any unwanted lift provided by the parasail may be compensated for by suitably adjusting the wings, preventing the boat from lifting uncontrollably out of the water, while optimally using the available wind.

In an aspect, a boat stabilizer is provided, the boat stabilizer comprising: an upper harness having: a body and; an assembly control system having a plurality of wing angle controllers and a plurality orientation locks; four wing assemblies attached to the body, each wing assembly comprising: a wing secured to a corresponding wing angle controller and a corresponding orientation lock; a controllable parasail comprising: a parasail canopy; a plurality of parasail cords secured to the parasail canopy; a parasail mount secured to the plurality of parasail cords and the upper harness; a parasail control rudder pivotally secured to the parasail cords, the parasail control rudder comprising: a first adjustment panel configured to be rotated on a yaw rotational axis; a second adjustment panel configured to be rotated on a pitch rotational axis, wherein the pitch rotational axis and yaw rotational axis are perpendicular to each other; a yaw controller secured to the upper harness; a pitch controller secured to the upper harness; a yaw cable secured to the yaw controller and the first adjustment panel, wherein the yaw controller is configured to adjust the yaw cable to selectively rotate the first adjustment panel on the yaw rotational axis; and a pitch cable secured to the pitch controller and the second adjustment panel, wherein the pitch controller is configured to adjust the pitch cable to selectively rotate the second adjustment panel on the pitch rotational axis. Again, an advantage is that as the boat travels forward, a lift force will be applied on the wings and thus, the attached boat, raising it out of the water, resulting in a reduced turbulence from being risen above some waves, preventing or lessening seasickness in passengers. Another advantage of the supplied lift is that it may increase speed, fuel milage and/or travel distance of the boat as a result of reducing the amount of drag experienced by the boat by the surrounding water during travel. Another advantage is that boat longevity may be increased as a result of decreased impact force and frequency from waves as a result of the supplied lift. Another advantage is that the wing angles may be adjusted to keep the boat steady and upright during strong winds, turbulent waters or other hazardous conditions. Another advantage is that this technology may be applied to a boat with only minor modifications and may be deployed or withdrawn at will. Another advantage is that the controllable parasail may be used to provide additional lift and propulsion to the attached boat, as well as steering capabilities in the form of directional control enabled by the yaw controller. Another advantage is any unwanted lift provided by the parasail may be compensated for by suitably adjusting the wings, preventing the boat from lifting uncontrollably out of the water, while optimally using the available wind.

In an aspect, A boat stabilizer is provided, the boat stabilizer comprising: a controllable parasail having: a parasail canopy; a plurality of parasail cords secured to the parasail canopy; a parasail mount secured to the plurality of parasail cords, wherein the parasail mount is configured to attach to a boat; a parasail control rudder pivotally secured to the parasail cords, the parasail control rudder comprising: a first adjustment panel configured to rotate on a yaw rotational axis; a second adjustment panel configured to rotate on a pitch rotational axis; a yaw controller; a pitch controller; a yaw cable secured to the yaw controller and the first adjustment panel, wherein the yaw controller is configured to adjust the yaw cable to selectively rotate the first adjustment panel on the yaw rotational axis; and a pitch cable secured to the pitch controller and the second adjustment panel, wherein the pitch controller is configured to adjust the pitch cable to selectively rotate the second adjustment panel on the pitch rotational axis. Again, an advantage is that the controllable parasail may be used to provide additional lift to an attached boat, as well as steering capabilities in the form of directional control enabled by the yaw controller. Another advantage is that a parasail deployer may be incorporated into the boat stabilizer in order to allow the parasail to reach the proper elevation to utilize higher elevation winds.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
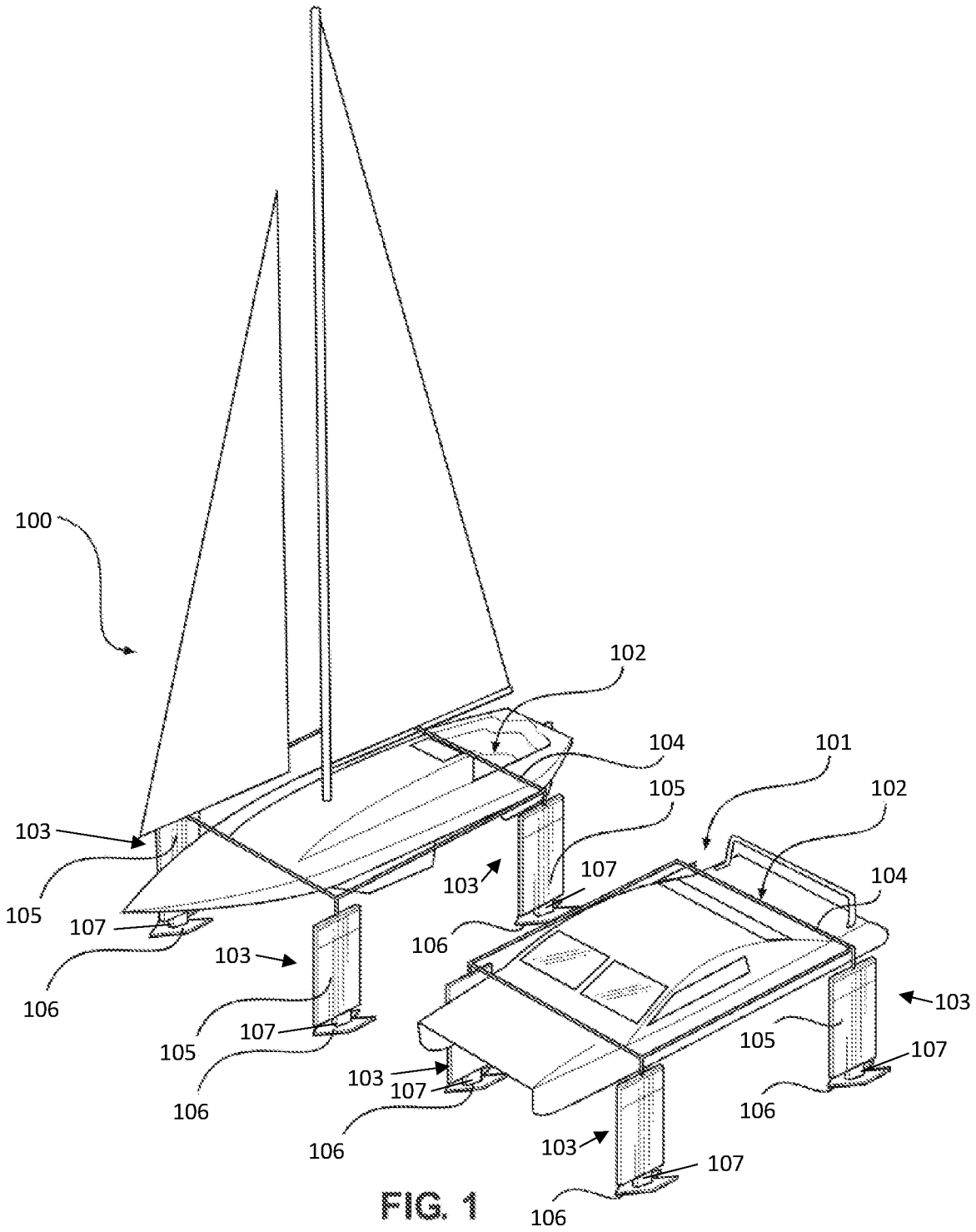
FIG. 1 illustrates the top perspective view of two boats, one being a sailboat, the other being a motorboat, each with a boat stabilizer installed, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 105 and 205, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1 illustrates the top perspective view of two boats, one being a sailboat 100, the other being a motorboat 101, each having a boat stabilizer 102 installed, according to an aspect. A boat stabilizer 102 is provided, the boat stabilizer comprising: an upper harness 104 for attachment to a vessel having: a bow beam running straight across the bow side of the vessel and beyond the port and starboard sides of the vessel, terminating in port and starboard end sections respectively; a stern beam running straight across the stern side of the vessel and beyond the port and starboard sides of the vessel, terminating in port and starboard end sections respectively; a port beam connecting the port side end sections of the bow and stern beams; a starboard beam connecting the starboard side end sections of the bow and stern beams; an assembly control system (not shown) having four orientation locks, each one attached to a different end section and comprising a rotation couple, a locking key and a locking screw, and two wing angle controllers, each having a base and a handle, with the base attached to one of the upper harness beams and the handle attached to the base and four wing assemblies 103, each one attached to a different orientation lock and comprising: a rod junction (not shown), having an upper central portion attached to a corresponding wing angle controller by a control pivot joint (not shown), a front end pivot joint and a back end pivot joint; a front rod and a back rod (not shown), each rod having a top portion attached to a corresponding end pivot joint, a middle section and a bottom section; a wing 106 having a front portion, a back portion, a central mount located between the front and back portion, a front mount on the front portion and attached to the bottom section of the front rod, and a back mount on the back portion attached to the back rod by the bottom section of the back rod; a wing pole 107 having a bottom end attached to the central mount by a wing pivot joint (not shown), and a top end; a wing mount 105 attached to the wing pole 107, the wing mount having a bottom part, a front part having a sharpened edge, a back part, a top part, a front slot surrounding the middle section of the front rod, and a back slot surrounding the middle section of the back rod and a control pole (not shown) having a bottom end attached to the top part of the wing mount and top end attached to the rotation couple of the corresponding orientation lock.

The boat stabilizer 102 described herein may be installed on a variety of different types of vessels with only minor modifications needed. The benefits afforded from the implementation of this boat stabilizer 102 may provide significant advantages to most vessels, regardless of size or propulsion method. The wing assemblies 103 may be rotated by the implemented assembly control system (not shown) such that the attached wings 106 are fully deployed below the vessel, in their operational position, or surfaced along the port and starboard sides of the vessel, in their non-operational position through manipulation of their respective orientation locks (not shown). When the wing assemblies 103 are rotated into the water, sharpened leading edges on the front part of the attached wing mounts may be facing in the intended travel direction, in order to take advantage of their superior hydrodynamic properties, as well as protect the rods from the force of the passing water as the vessel travels. The wing mounts 105 are attached to their respective wings 106 by wing poles 107 using pivot joints (not shown), such that wing mounts always retain their desired orientation, despite the angling of the wings. The rotational capability of the wing assemblies 103 allows the boat stabilizer 102 to deploy its wing assemblies as needed, affording the attached vessel enhanced versatility depending on the operation environment. The pitch angle of the wings 106 may be adjusted through manipulation of the proper wing pitch controller (not shown) located on the upper harness 104 Cables (not shown) incorporated in the assembly control system and located on the upper harness may connect each wing pitch controller to its respective wing assemblies 103, enabling manipulation of the rods (not shown) attached to each the wings 106, and thus manual adjustment of the pitch angle of each wing 106. A rudder (not shown) may also be implemented as part of the boat stabilizer 102 assembly, to allow for the attached vessel to be steered in the absence of a preexisting, functional steering mechanism. This rudder may be controlled by a passenger through means comparable to those used in the industry but must be a proper length such that it is always partially submerged in the water, despite any lift imparted on the vessel, and be capable of being rotated out of the water, much like the wing assemblies 103. The rudder may be attached to the upper harness 104 by an orientation lock (not shown) in such a way that the rudder is positioned of off the stern side of the attached vessel.

The implementation of a boat stabilizer on a vessel allows for the force exerted on the wings 106 while traveling forward to be converted into a lift force being applied to the attached vessel. When the vessel is elevated higher, it may experience less turbulence from the waves below, reducing both the likelihood and severity of seasickness in susceptible passengers. The elevation of the vessel higher above the waves may also have the added benefit of reducing both wave impact strength and frequency on the vessel hull, effectively improving vessel longevity. The elevation of the vessel higher out of the water reduces the water/vessel interface area, reducing the amount drag experienced by the vessel, and potentially increasing its speed, travel distance and fuel mileage, as applicable. The feature of active wing 106 pitch angle adjustment may provide safety benefits under strong wind, rough water or other hazardous conditions by allowing each wing to be adjusted at will to compensate for environmental factors to help keep the vessel upright, level and stable. Being able to deploy or withdraw the wings assemblies 103 to and from the water provides the vessel with additional versatility where sub-vessel clearance may become an issue. The versatility of the boat stabilizer 102 allows it to be incorporated into many different types of vessels, such that they may be enhanced by the benefits provided by this technology. Additionally, the modular nature of the boat stabilizer 102 may allow for easier modification or repair of components, when compared to existing technology.

The elements of the boat stabilizer 102 may be connected accordingly to allow for the required element functionality. The beams of the upper harness may be welded together or attached through similar means. The upper harness may be attached to the vessel by using rivets, welding, or other suitable method. Pivot joints capable of rotating about a singular axis may be used in the connection of various elements, including the connections between the rods and rod junctions, rods and wings 106, rod junctions and assembly control system, and wing poles 107 and wings 106. Each wing angle controllers is connected to its respective wing assemblies by a cable within a cable pulley system (not shown) to allow for manipulation of the wing pitch angle through usage of its attached handle, while also having its base suitably attached to the upper harness, through welding or comparable means. The control pole (not shown) may connect to the upper harness by being welded to an orientation lock, such that the rotation of the control pole results in the rotation of the whole wing assembly 103. In another example, the control pole may be included as part of the wing pole, with the resultant combined wing pole being attached to both the wing mount and the orientation lock. A rudder may also be connected to the upper harness 104 similarly to the control poles using an orientation lock such that it may also be manually rotated to and from the water at will. Due to the boat stabilizer 102 being composed of various unique and separable elements, the system may have many of its pieces modified or replaced with relative ease compared to many current technologies.

Figure 2A:
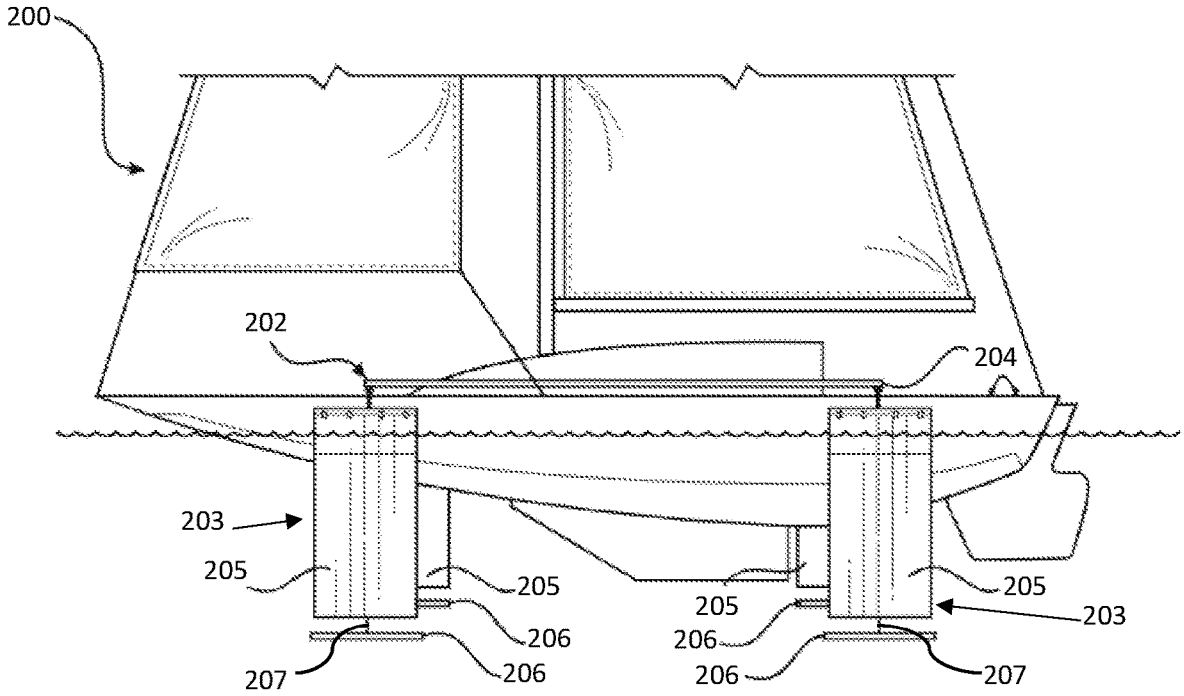
FIG. 2A-2C illustrate the side view and top view of a sailboat with a boat stabilizer installed according to an aspect.
Figure 2B:
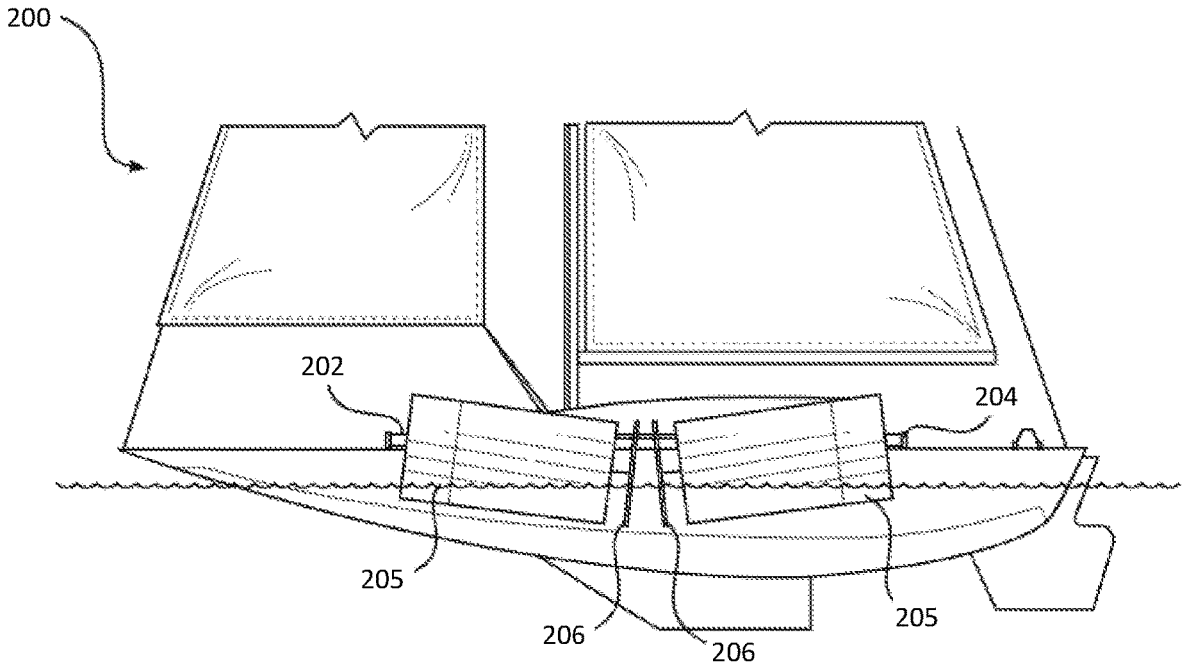
Figure 2C:
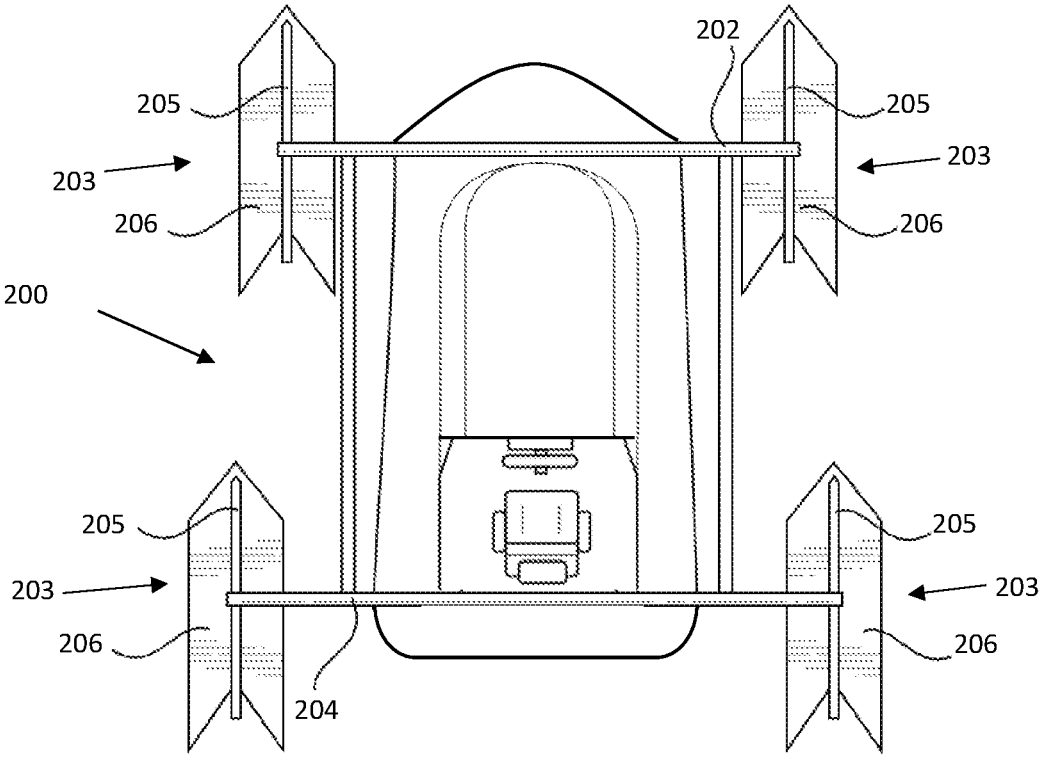
Figure 3A:
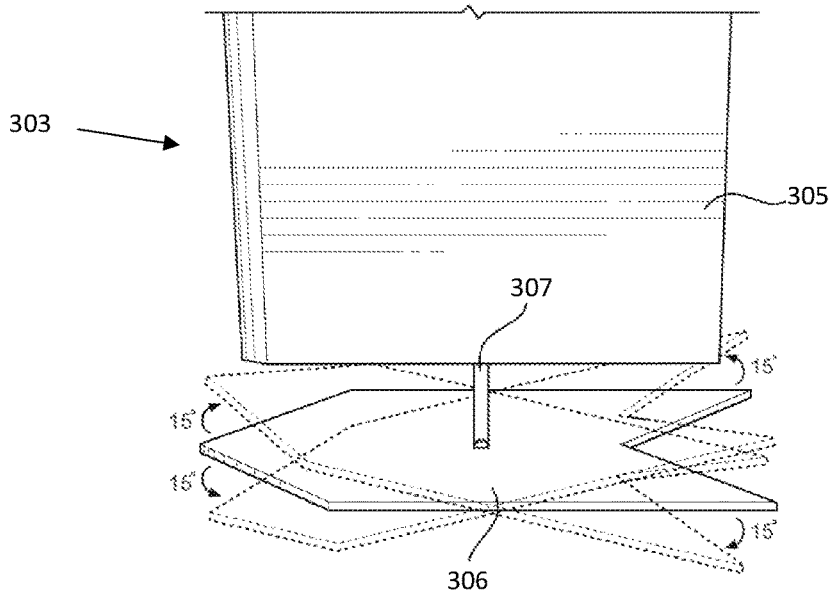
FIG. 3A-3F illustrate the side perspective view of wing assemblies of a boat stabilizer, according to an aspect.
Figure 3B:
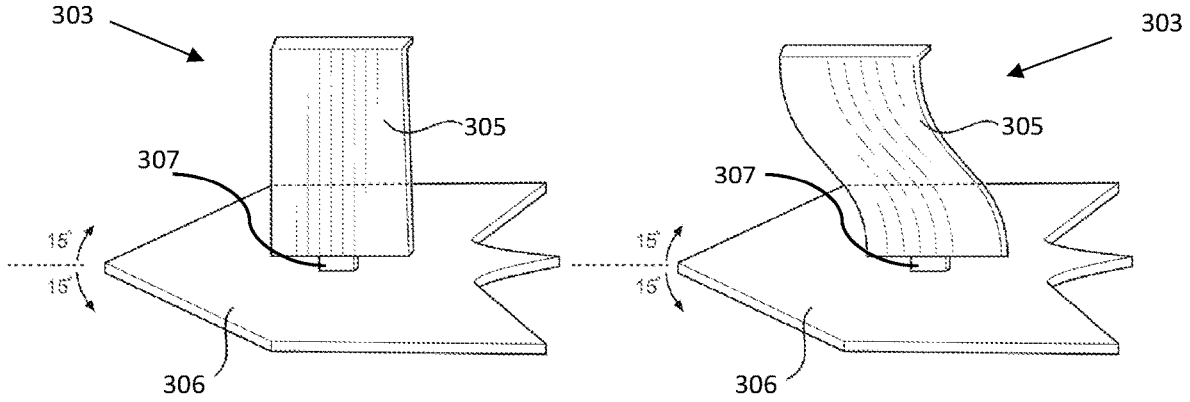
Figure 3C:
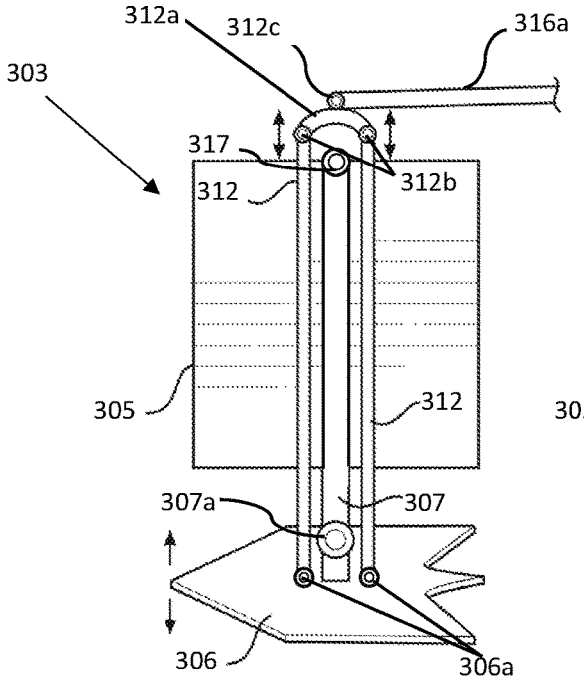
Figure 3D:
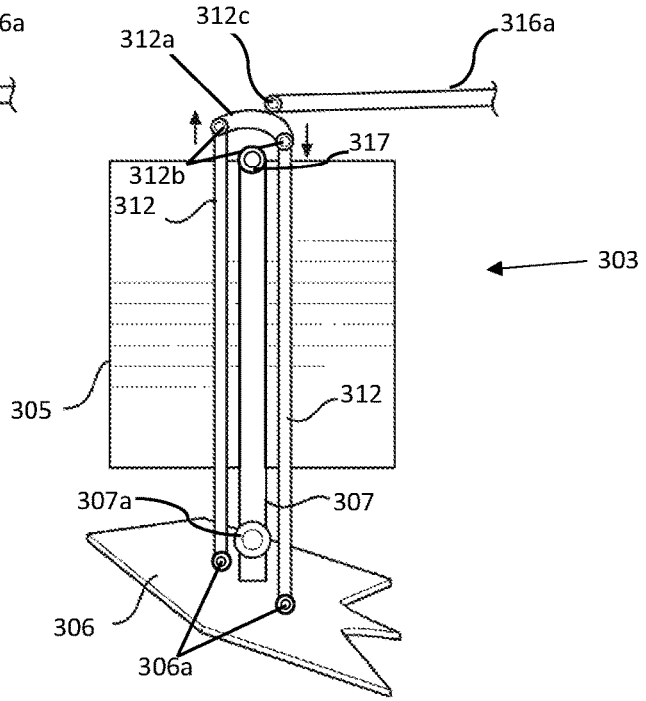
Figure 3E:
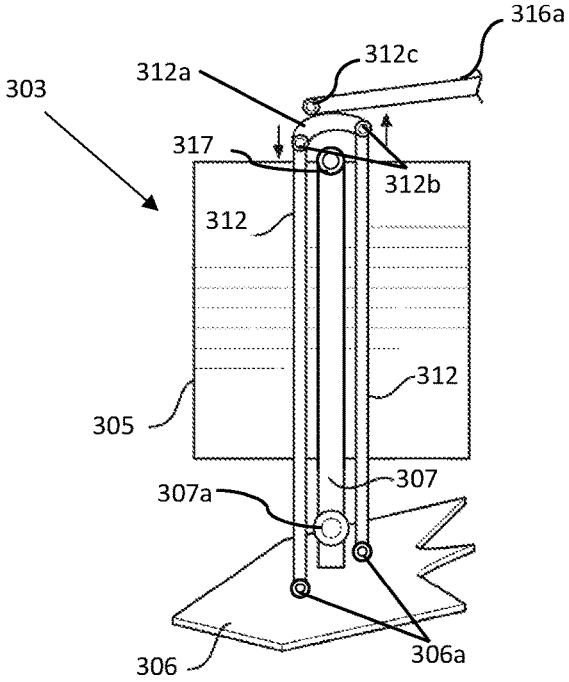
Figure 3F:
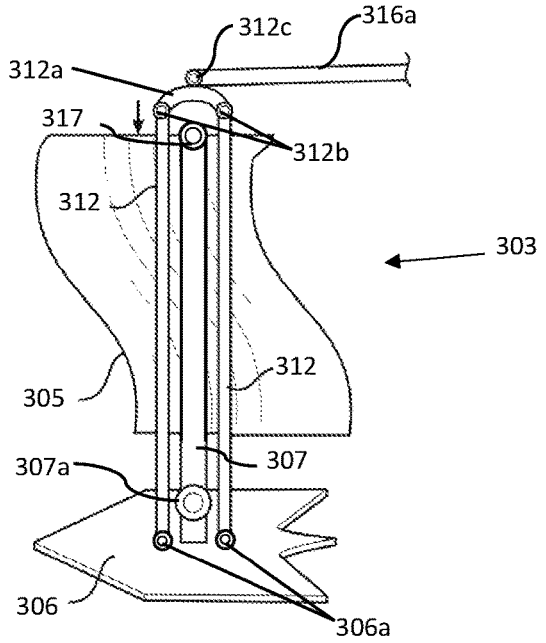

FIG. 2A-2C illustrate the side views and top view of a sailboat 200 with a boat stabilizer 202 installed, according to an aspect. The boat stabilizer described herein may be set in different positions through rotation of its wing assemblies 203, including its operational position, with the wing assemblies 203 rotated vertically with their wings 206 submerged in the water as they are in FIG. 2A, or its nonoperational position, with the wing assemblies 203 rotated horizontally as they are in FIG. 2B. The hereinabove described wing assembly rotation is enabled through the implementation of orientation locks (not shown) between each wing assembly 203 and the upper harness 204 assembly. In its operational position, the boat stabilizer 202 can adjust the pitch angles of both port side wings 206 or both starboard side wings 206 through manipulation of the appropriate wing angle controller. One advantage of this is that the boat stabilizer 202 may be able to compensate for strong winds or other conditions to ensure that the attached vessel remains upright, stable, level and does not capsize, while significantly reducing the turbulence experienced for passengers on the boat. In addition to the inherent safety benefits of keeping the boat more stable despite environmental conditions, this increased stability may also help reduce the likelihood and/or severity of seasickness cases for passengers. Due to the lifting of the vessel that may occur as a result of the installed boat stabilizer 202, the boat may also be risen above potentially rough waters. One result of this is that the vessel may experience less strain, wear and tear that may result from repeated impact of the vessel with the surface of the water that may occur when riding in rougher waters. The lifting of the vessel partially out of the water may help increase the longevity of the vessel while simultaneously providing a smoother, safer ride.

Aside from the passenger safety and vessel longevity benefits described above, the boat stabilizer 202 may also provide advantages for the vessel in terms of its efficiency. Since the angle of the wings 206 may result in a lift force being applied to the attached vessel, the amount of drag experienced by the vessel as it travels through the water may be reduced as a result of the reduction of water/vessel interface area. The reduction of drag on the vessel during travel allows a supplied propulsion method, including an attached sail or motor unit, to propel the boat with greater efficacy. This may result in faster speeds and greater travel distances for most types of vessels, including sailboats, and additionally enhanced fuel milage for vessels with fuel-based propulsion methods.

As can be seen in FIG. 2C, the upper harness 204 is implemented to its attached boat 200 in such a way that the wing mounts 205 and their attached wings 206 are positioned at the perimeter of the boat, with the bow side wings 206 spanning beyond the front of the vessel bow and stern side wings 206 spanning beyond the back of the vessel stern. The placement of these wings 206 at perimeter of the boat helps to ensure that the lift force that may be applied to the vessel is applied in a balanced manner, rather than to just one portion of the boat. This method of placing the wing mounts 205 beyond the perimeter of the vessel provides the vessel with a more widely spread lengthwise contact surface with the water, and thus provides greater stability. This method of positioning the wing mounts 205 at the perimeter of the vessel is the preferred method of wing mount 205 positioning, due to the greater resultant vessel stability.

FIG. 3A-3F illustrate the side perspective views and side cross-sectional views of wing assemblies 303 of a boat stabilizer, according to an aspect. It should be understood that for the purposes of clarity certain elements of the wing assembly are omitted from each figure in order to better articulate the characteristics and functionalities of each element. The wings 306 are capable of being pitched upward or downward in order to achieve the desired effect on vessel operation, whether that be compensation for wind or water conditions, or optimization of vessel lift. The suggested operational pitch angle of a wing is about +/−15 degrees from the horizontal position. Each wing 306 is connected to two rods 312, with both rods connected to a rod junction 312*a* by pivot joints 312*b* such that the rods may be adjusted to control wing pitch without changing their orientation. The wing pole 307 is attached to the wing 306 by a wing pivot joint 307*a*, such that the wing pole 307 may also retain its orientation, despite the angling of the wing. As seen in FIG. 3C-3F, the control pole (not shown) may be integrated into the wing pole 307, such that the wing pole 307 may attach the wing mount directly to the orientation lock 317. Both rods 312 are partially disposed within a wing mount 305, which they travel through along its length. Both rods 312 may be connected to their respective wing by wing pivot joints 306*a*, such that they may be manipulated to change the pitch angle of the connected wing, without changing their orientation. The rod junction 312*a* is connected to a wing angle controller (not shown) implemented as part of the assembly control system by a control joint 312*c*. This control joint 312*c* allows for rotation of the rod junction 312*a* through manipulation of an attached cable pulley system 316*a* controlled by its connected wing angle controller. A singular wing pitch angle controller (not shown) may be used to simultaneously manipulate both wings 306 on either the port side or the starboard side of the vessel, such that one wing pitch angle controller may control both port side wings 306 and a second wing pitch angle controller may control both starboard side wings 306. Though manual manipulation of cables may be used in the disclosed boat stabilizer to adjust the wing angle, one may also choose to implement electric elements, such as motors, for wing pitch adjustment.

As shown through FIG. 3A through FIG. 3F, both the wings 306 and wing mounts 305 may be implemented in a variety of shapes and styles as needed. The shape of wing mounts may be modified to be curved, as they are in FIG. 3F, straight, as they are in FIG. 3C, or potentially other shapes as needed. The preferred shape for a wing mount is the curved variant of FIG. 3F, which has superior hydrodynamic properties when compared to the straight mount, resulting in less drag. The same variability may also be applied to the wings 306, which may be "bird shaped" as they are in FIG. 3B, chevron shaped as are in FIG. 3A, or potentially other shapes as needed. The preferred shape for a wing is the "bird shaped" variant of FIG. 3B, which has a larger surface area that helps to better control the vessel during travel. Furthermore, the preferred combination may be seen in FIG. 3F, which implements a "bird shaped" wing and curved wing mount. Further variation of the shapes of the wings 306 and wing mounts 305 may allow for a more durable construction, lighter weight, greater lift, or a variety of other improvements.

Figure 4:
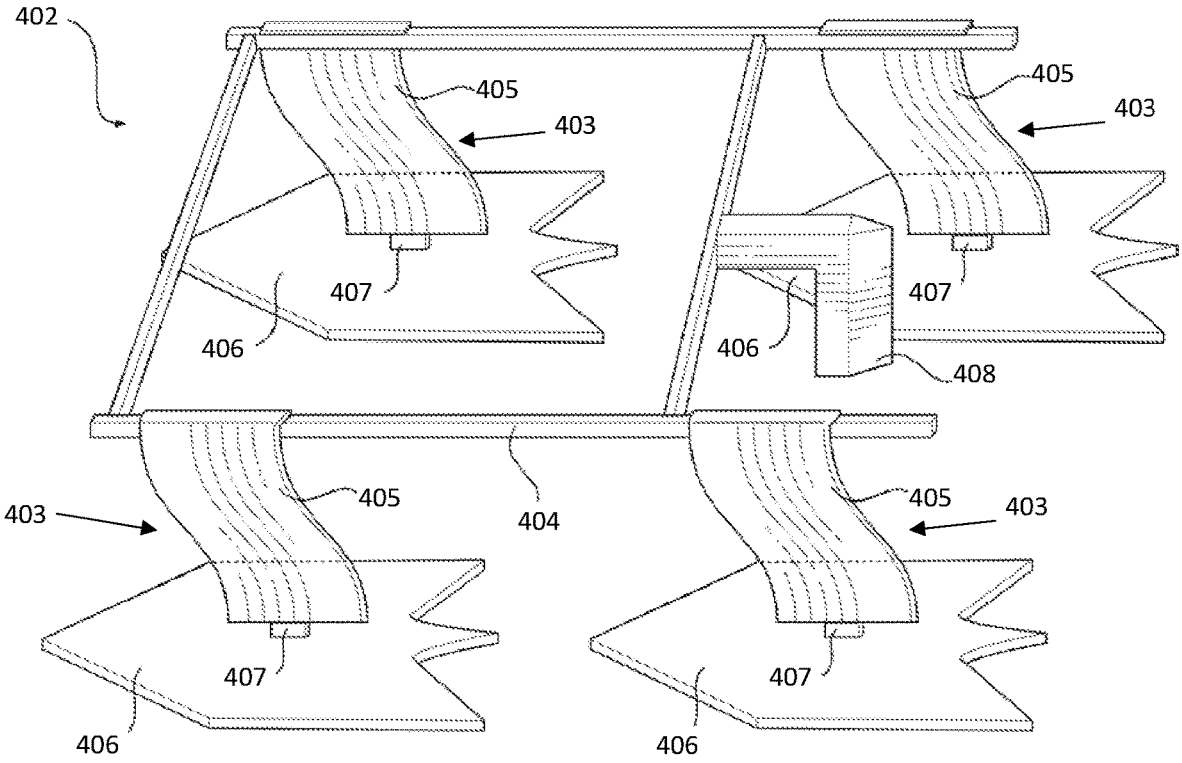
FIG. 4 illustrates the side perspective view of a boat stabilizer, according to an aspect.

FIG. 4 illustrates the side perspective view of a boat stabilizer 402, according to an aspect. As mentioned, it should be understood that certain elements are not shown in this figure for purposes of simplification. The boat stabilizer 402 may be provided as a kit and be implemented as a removeable part of a vessel, with minimal modifications required to the vessel itself. The boat stabilizer 402 may also be built into the vessel itself during vessel construction. While the lift provided to the vessel by the boat stabilizer 402 may provide a wide array of benefits, it may also result in preexisting steering mechanisms being lifted fully out of the water. In order to compensate for this, an attached rudder 408 may be used to direct the vessel during travel. The single rudder assembly provided may be attached to the upper harness 404 in such a way that it may be rotated out of the water, such as by incorporating an orientation lock (not shown), much like those described for use with the wing assemblies 403. The rudder 408 is of such a length that even while the attached vessel is lifted above the water's surface during travel, the rudder 408 will be partially submerged to provide directional control to the vessel. The mechanism through which the rudder 408 enables steering for the vessel is similar to those found in the industry and may be adjusted manually by onboard personnel. As noted previously, the rudder 408 may be positioned behind the stern of the vessel.

The usage of an assembly control system (not shown) may allow for the adjustment of wing 406 pitch angle through manipulation of the wing pitch controllers, and the deployment and withdrawal of the wing assemblies 403 into and out of the water through manual manipulation of their orientation locks (not shown). This assembly control system may adjust the boat stabilizer elements manually, electronically, through inputted user commands, or autonomously through an automated system. This may include incorporation of electric motor systems placed at the top of the wing assemblies 403 that may adjust both the wing 406 pitch and wing assembly 403 angles.

Figure 5A:
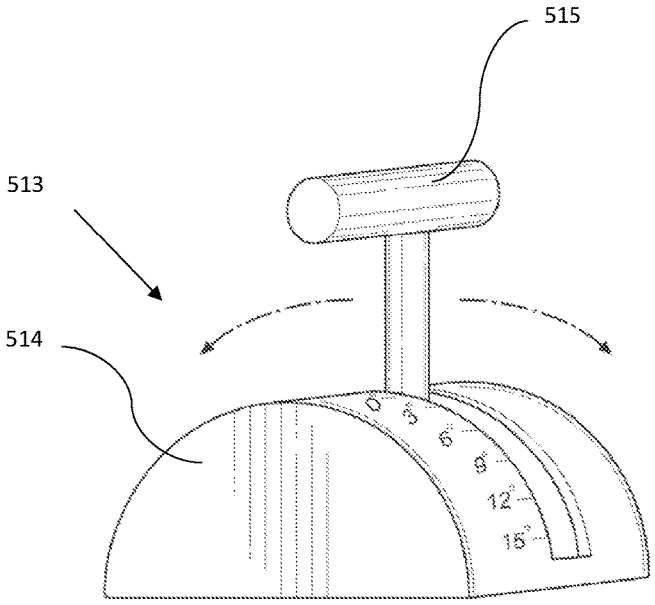
FIG. 5A-5B illustrate the side perspective and top view of a rounded wing pitch angle controller respectively, according to an aspect.
Figure 5B:
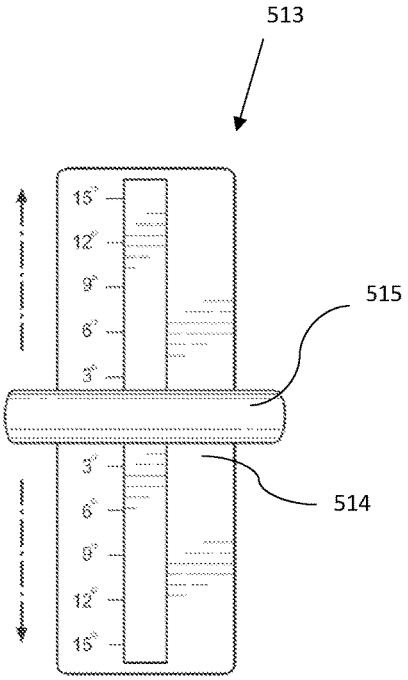

FIGS. 5A and 5B illustrate the side perspective and top view of a rounded wing pitch angle controller 513 respectively, according to an aspect. A wing pitch angle controller 513, comprised of a controller base 514 and handle 515, may be used in order to manipulate the wings located on the wing assemblies. One wing pitch angle controller 513 may be used to control both of the wings on either the port side or the starboard side of the vessel. Both wing assemblies on the port or starboard side may have a wing angle controller 513 connected to their respective rod junctions by a cable 516 to allow for wing adjustments to be made to two wing assemblies simultaneously. Each wing angle controller 513 may be connected by its base 514 to the upper harness by welding or other suitable means. Manipulation of the handle 515 may move the cable within a cable pulley system (not shown) to apply a rotational force upon its respective rod junctions (not shown) to change the wing pitch angles on either the port or starboard side wing assemblies (not shown).

The capability of the boat stabilizer to manipulate the wing pitch angles of the port and starboard sides of the vessel independently of each other provides it with certain benefits. Vessels with uneven weight distributions may adjust each of the wings during travel to ensure that the vessel remains upright, level, and comfortable. Such an instance may occur if a vessel needed to carry a piece of cargo of significant weight, without having anything to use as a counterweight. Also, as mentioned previously, in the event of weather or water conditions that may rock the vessel, the individual wing adjustments may also help to compensate for these forces. While the wing pitch angle controllers described herein use only manual mechanisms for wing pitch angle adjustment, one may also implement comparable electronic mechanisms to achieve the same results, such as including a motor with an electronic controller.

Figure 6A:
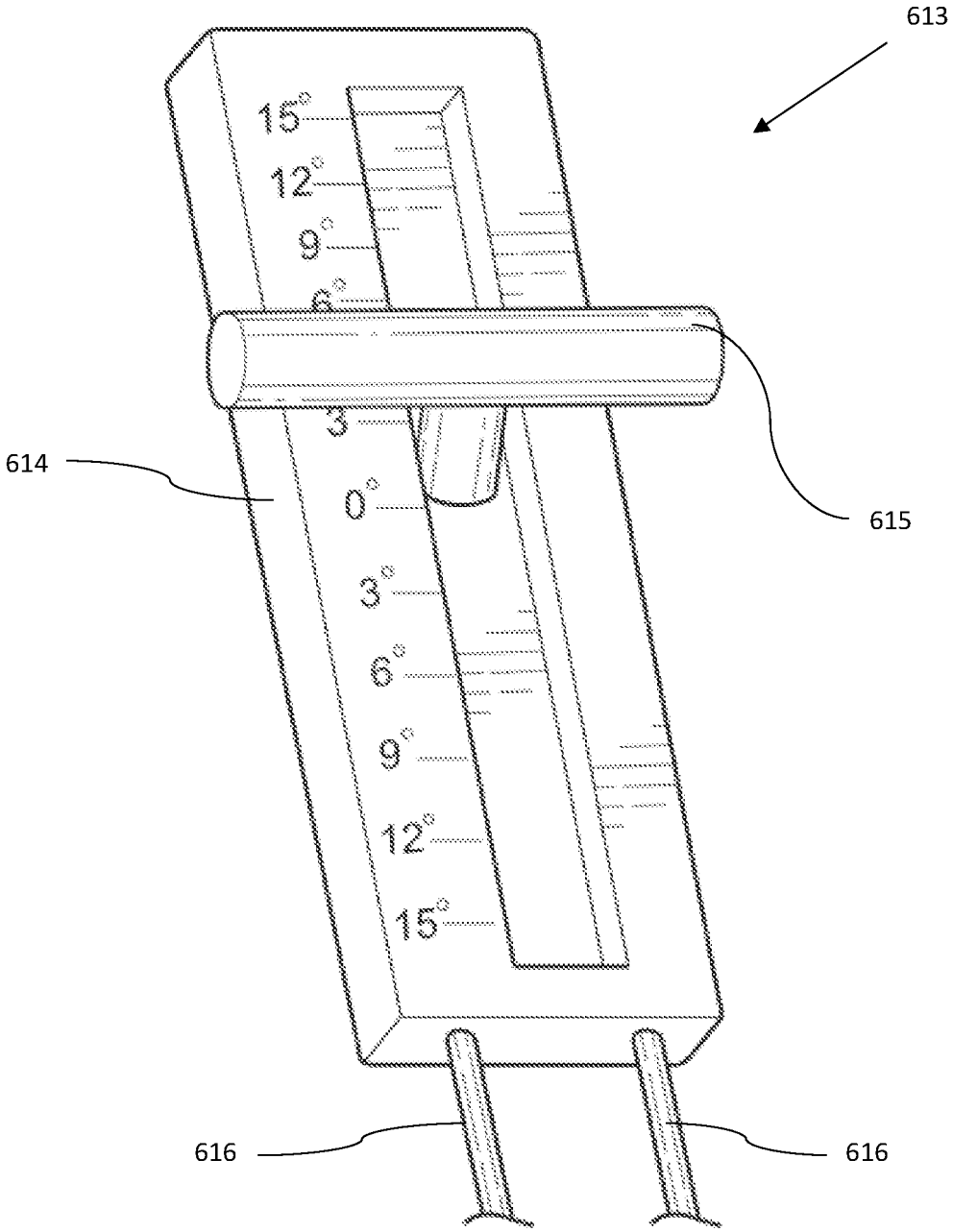
FIG. 6A-6C illustrate the top perspective view of a rectangular wing pitch angle controller connected to a cable and side cross sectional views of a rectangular wing pitch angle controller attached to wing assemblies, respectively, according to an aspect.
Figure 6B:
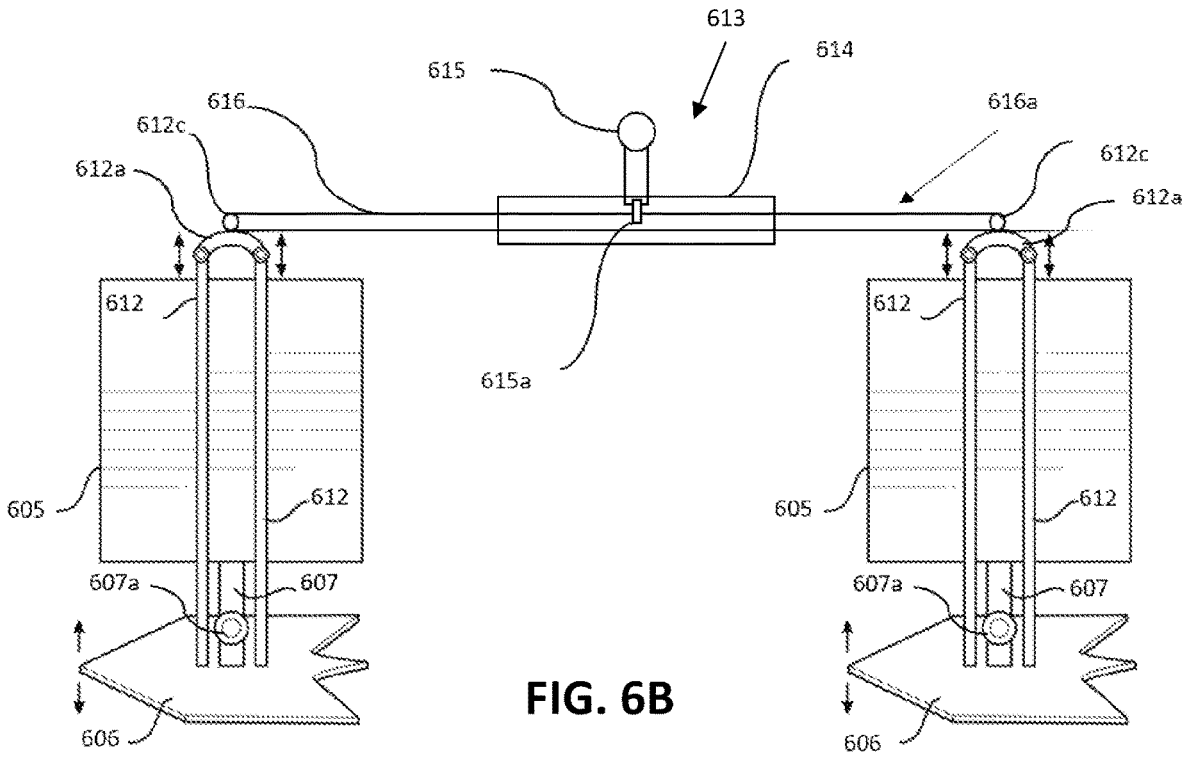
Figure 6C:
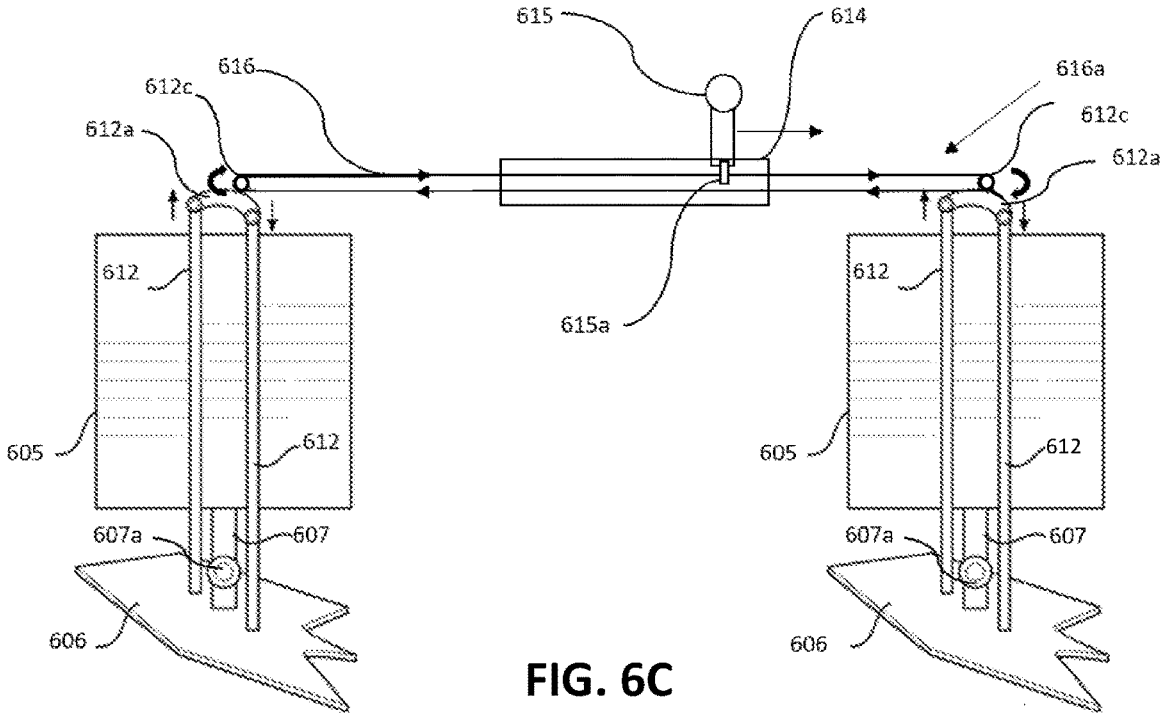

FIG. 6A-6C illustrate the top perspective view of a rectangular wing pitch angle controller 613 connected to a cable 616 and a side cross sectional views of a rectangular wing pitch angle controller 613 attached to wing assemblies 603, respectively, according to an aspect. The shape of the controller base may be varied to be rounded as it was in FIG. 5 or rectangular it is in FIG. 6A-6C, as long as its intended functionality is not hampered. As mentioned above, the wing pitch angle controller 613 may change the wing pitch angles through manipulation of an attached handle 615. This handle 615 connects to the incorporated cable 616, which may be connected to two rod junctions 612*a* by their control joints 612*c*. The cable 616 may be implementation as part of a cable pulley system 616*a*. The cable 616 may be connected to the handle 615 by a handle link 615*a*. The cable pulley system may be arranged such that manual manipulation of the handle 615 results with a corresponding rotational force being applied to the rod junctions, through the rotation of the cable 616 along the cable pulley system 616*a*. This in turn may result in the wings 606 being pitched downward from moving the handle 615 in one direction, and the wings 606 being pitched upward from moving the handle 615 in the other direction, as seen in FIG. 6C.

Figure 7A:
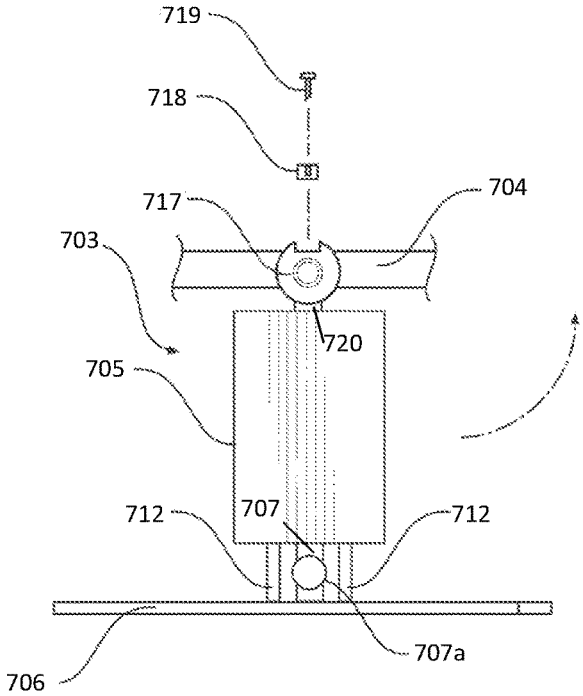
FIG. 7A-7B illustrate side perspective views of a wing assembly with an orientation lock, according to an aspect.
Figure 7B:
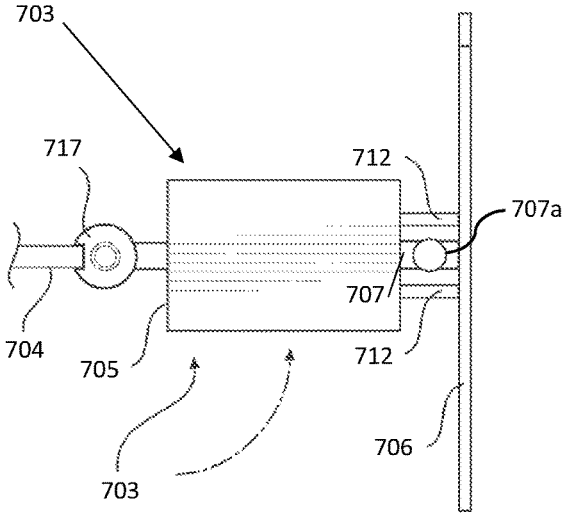

FIG. 7A-7B illustrate side perspective views of a wing assembly with an orientation lock, according to an aspect. A key feature of this invention is the ability to deploy and withdraw the wing assemblies 703 to and from the water as needed. This feature is enabled through the implementation of orientation locks between each of the wing assemblies and the upper harness 704. The orientation locks may be comprised of a rotation couple 717 fitted around an end section of the upper harness, a locking key 718 and a locking screw 719. The wing mount 705 may be attached to the rotation couple 717 by a control pole 720, having a bottom portion attached to the wing mount and a top portion attached to the rotation couple. The rotation couple 717 may rotate freely when the locking key 718 and locking screw 719 are not installed. Upon installation of the locking key 718 and locking screw 719, the rotation couple 717 will no longer be able to rotate. By attaching the rotation couple 717 to an end section of the upper harness 704 and the wing pole 720 of a wing assembly 703, the rotational orientation of the wing assemblies 703 may be changed manually through the removal of the locking key 718 and screw 719, manual rotation of a wing assemblies 703 to the desired orientation and subsequent reinstallation of the locking key 718 and screw 719. As described previously orientation locks may also be attached to a rudder, to allow for its deployment or withdrawal as needed.

Figure 8:
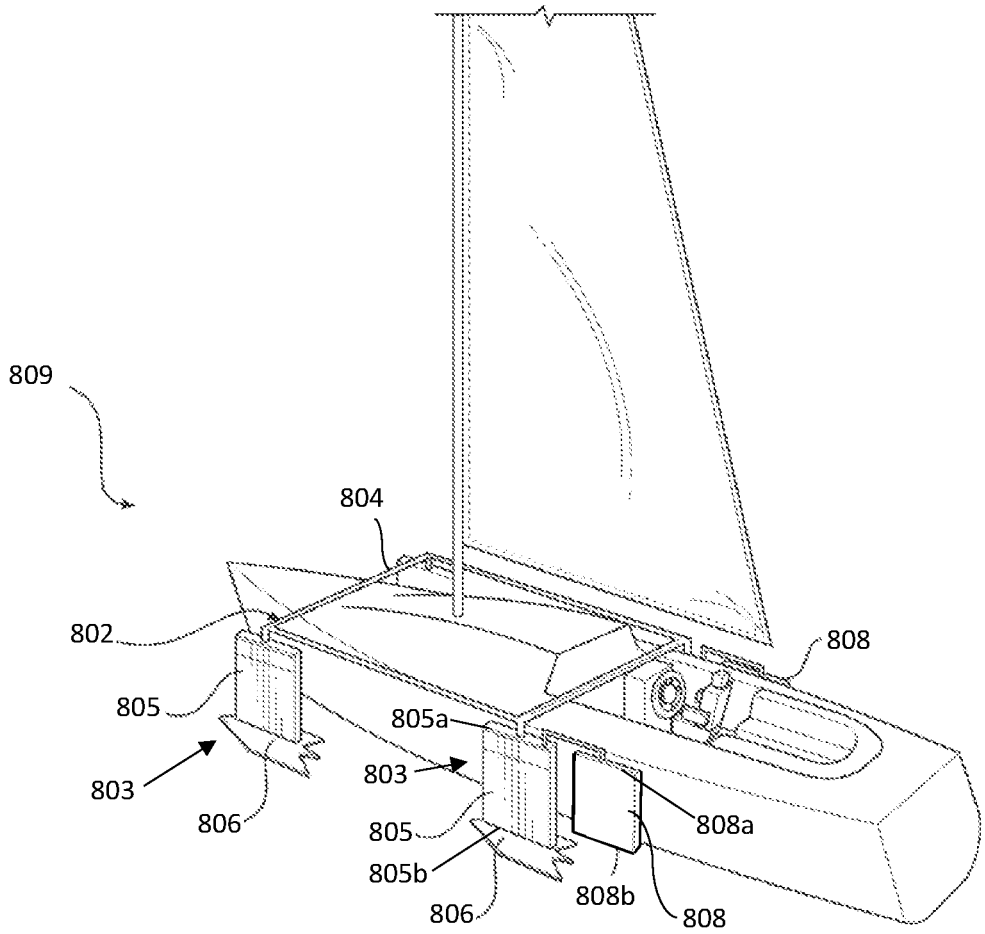
FIG. 8 illustrates the side view of a boat with a boat stabilizer installed, the boat stabilizer having two rudders, according to an aspect.

FIG. 8 illustrates the side view of a boat 809 with a boat stabilizer 802 installed, the boat stabilizer having two rudders 808, according to an aspect. As discussed previously, the lift provided by a boat stabilizer 802 may result in the lifting of preexisting steering methods, which may result in these steering methods becoming less efficient or entirely ineffective. In order to alleviate this potential issue, one or more rudders 808 may be implemented as part of the boat stabilizer 802 assembly. Much like the previously described rudders, these dual rudders 808 may be adjusted to provide steering means through mechanisms comparable to those present in the industry. Each rudder 808 may be implemented behind and attached to different stern side wing mount 805 at the stern of the vessel. The length of these dual rudders 808 is such that when the boat stabilizer 802 is in its operational position, the top edges of the rudders 808*a* align with the top edges of the wing mounts 805*a*, but the bottom edges of the rudders 808*b* are above the bottom edges of the wing mounts 805*b*. This is done in order to prevent the collision of the wing 806 with the rudders 808 during wing pitch and rudder adjustment.

As with the single rudder configurations described above, the rudders used with this assembly need to be of such a length that part of the rudders are submerged during travel, even with the associated lift, to provide directional control during travel. Additionally, the shape these rudders 808 behind the stern side wing mounts may be the same as their respective wing mounts 805, such that curved wing mounts have curved rudders, and straight wing mounts 805 have straight rudders 808. This will allow the rudders to be fit more closely to their respective wing mounts 805 while maximizing stern side clearance. While both the single and dual rudder layouts may be viable, the dual rudder 808 layout is preferred, as it provides superior steering control. Additionally, these dual rudders 808, may be rotated out of the water as a result of their attachment to the wing assemblies 803, removing the need for an additional rudder withdrawal mechanism. These rudders 808 may be the sole means of controlling vessel direction or be used in conjunction with other preexisting, operational directional control methods.

Figure 9:
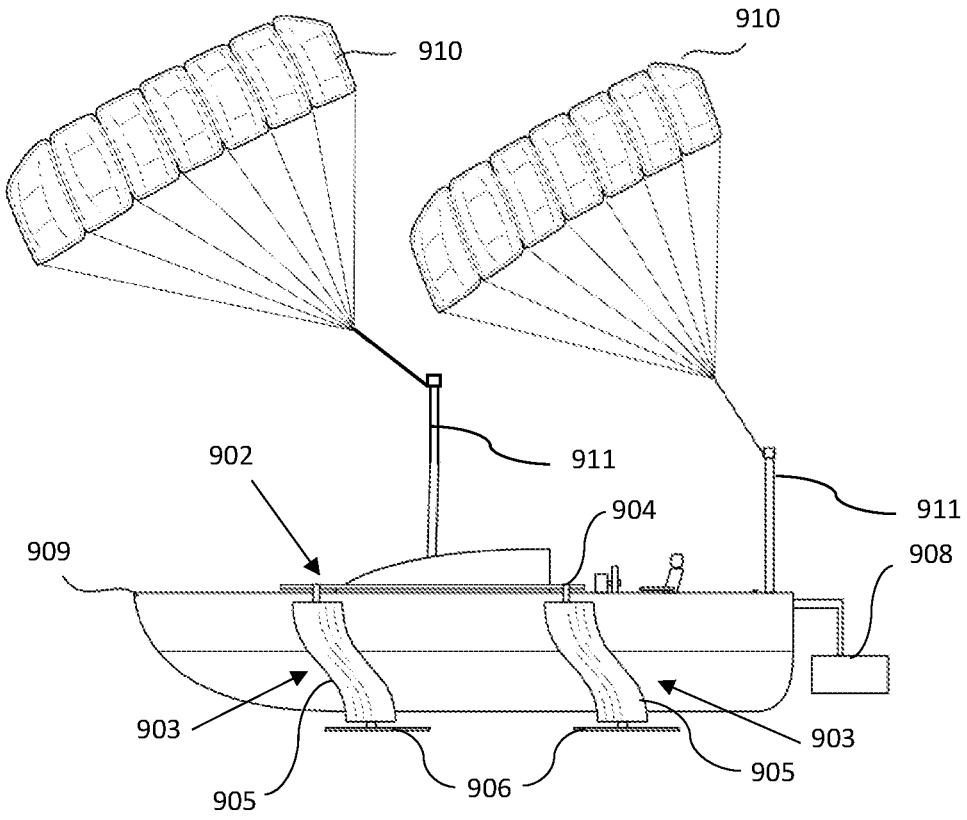
FIG. 9 illustrates the side view of a boat with a boat stabilizer and parasails installed, according to an aspect.

FIG. 9 illustrates the side view of a boat 909 with a boat stabilizer 902 and parasails 910 installed, according to an aspect. Additional peripherals may be implemented alongside a boat stabilizer 902, or potentially as part of the boat stabilizer 902, to make use of its provided benefits. One such peripheral is a parasail 910, which may be attached to the top of a vessel by an installed parasail mount 911 included as part of the vessel or boat stabilizer 902 assembly. A parasail 910 may be implemented to take advantage of the propulsive force of air currents. The parasails 910 may be able to take advantage of the propulsive forces of higher elevation winds than a conventional sail, depending on the length of their attached cord. When implemented on a vessel, parasails 910 may provide a vessel with an additional propulsion method that is similar to that of a conventional sailboat. Reduction of drag on the vessel as a result of lifting the vessel partially out of the water may allow the force provided by a parasail 910 to be used more efficiently. This may result in maintenance of higher vessel speeds as well as greater resultant distances traveled. A rudder 908 may be present on the on the vessel or boat stabilizer and positioned off the stern of the vessel and partially submerged in the water during travel. The rudder 908 may be used to direct the vessel during travel and may be incorporated as part of a boat stabilizer in the absence of, or in addition to, preexisting directional control methods on the vessel. This rudder 908 may need to be of a sufficient length to be partially submerged during travel, regardless of the potentially increased elevation of the vessel above the surface of the water.

Figure 10:
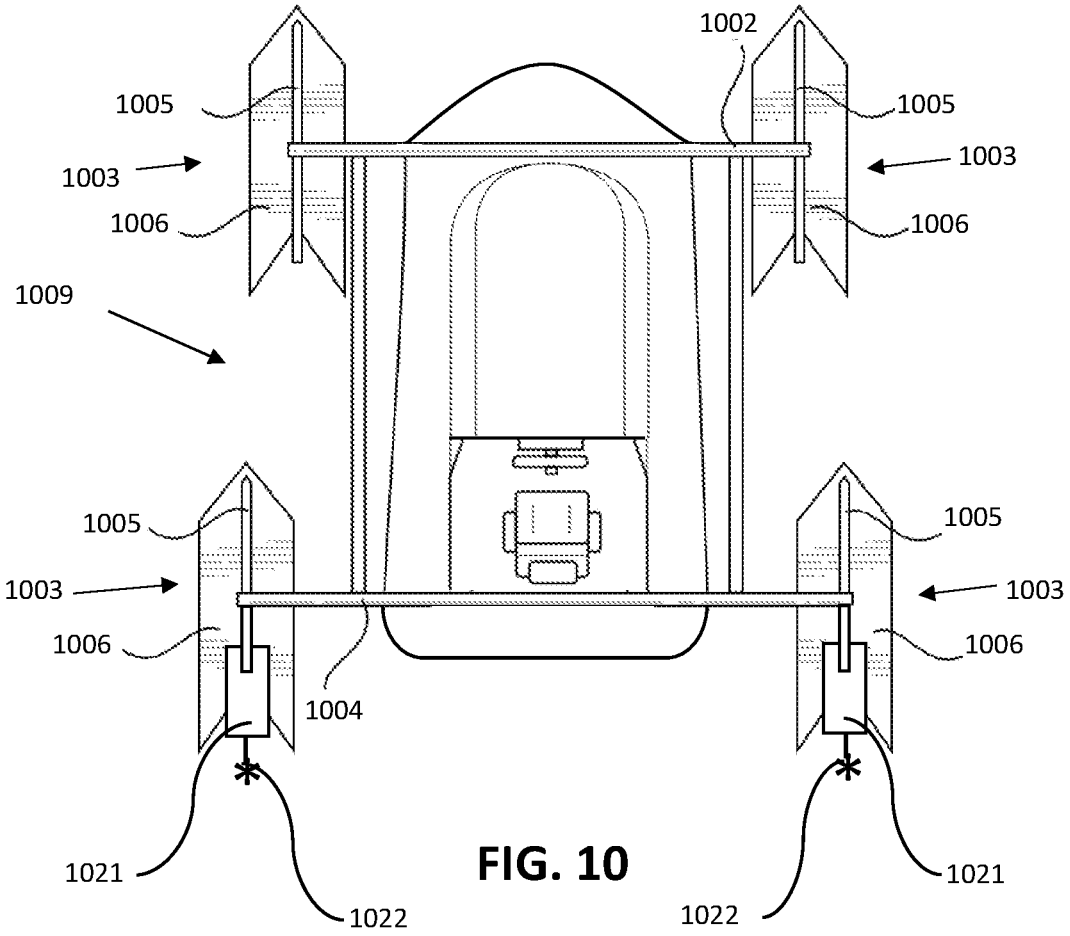
FIG. 10 illustrates the top view of a boat with a boat stabilizer having two electric motors with propellers installed, according to an aspect.

FIG. 10 illustrates the top view of a boat 1009 with a boat stabilizer 1002 and two electric motors 1021 with propellers 1022 installed, according to an aspect. As with the parasails (not shown) incorporated previously, many different methods of propulsion may be incorporated into a boat stabilizer 1002 assembly. A propulsion method that may provide a significant amount of utility in a variety of environments is an electric motor 1021 with attached propeller 1022. One may attach one electric motor 1021 to each stern side wing 1006 and connect a propeller 1022 onto each motor 1021, such that the spinning of the propeller 1022 by the motor 1021 provides forward propulsion to the attached boat 1009. Due to the positioning of each electric motor 1022 on stern side wings, the lowest elements of the boat stabilizer 1002 during operation, this dual motor 1021 propulsion method may always be capable of propelling the vessel, regardless of the amount of lift provided to said vessel and provide more vessel stability than a single motor assembly could. Theses dual motors 1021 with propellers 1022 may be implemented as an additional source of propulsion in the presence of functional propulsion methods on the boat stabilizer or vessel, or the sole means of propulsion in the absence of other functional or present propulsion methods. Also, like the hereinabove rudders, these motors 1021 and propellers 1022 must be positioned in such a way that they are properly submerged during operation, in order to be able to provide their desired function. The electric motors 1021 may be controlled by an onboard control device, comparable to those used in the industry and be attached to their respective wings 1006 through welding or equivalent methods. It should be understood that these electric motors 1021 with propellers 1022 may be incorporated into any smart boat stabilizer 1002 disclosed or described herein and may be utilized in any suitable quantity, such that a vessel may utilize one or more electric motors 1021 with propellers 1022 positioned in suitable locations on said boat stabilizer 1002 to provide the desired propulsion.

Figure 11A:
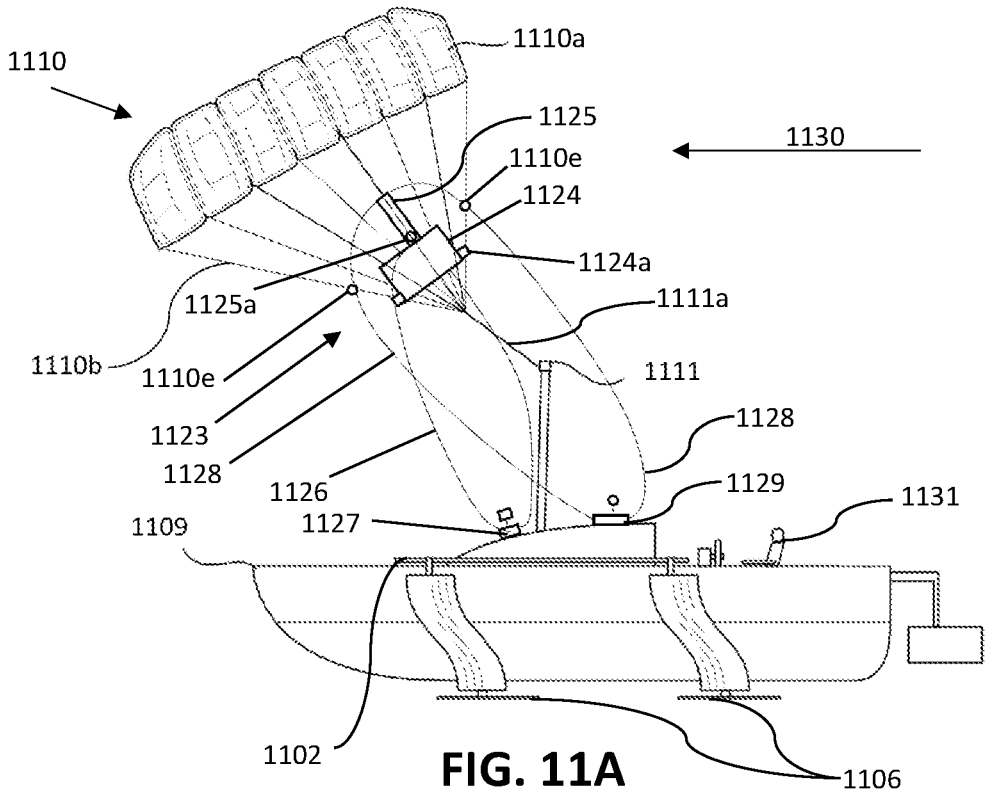
FIG. 11A-11B illustrates the side perspective view of a parasail having a parasail control rudder, according to an aspect.
Figure 11B:
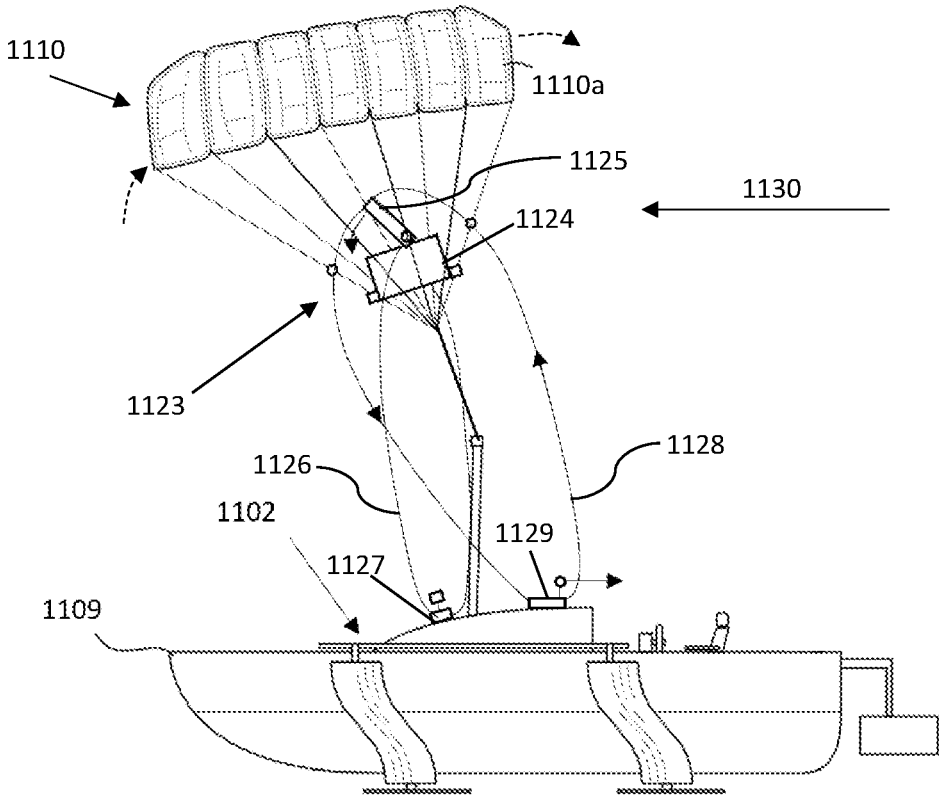
Figure 11C:
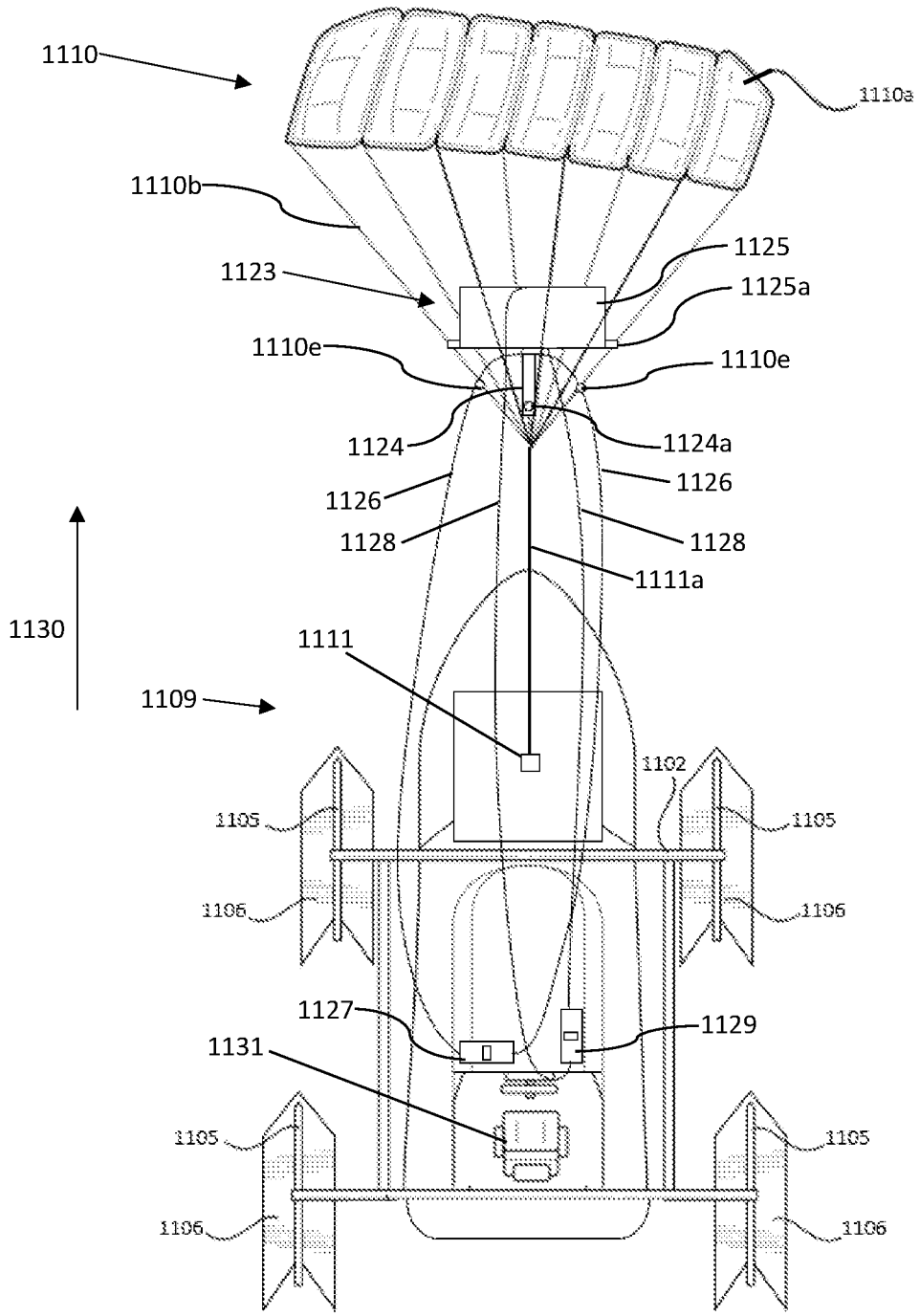
FIG. 11C-11D illustrates the top perspective view of a parasail having a parasail control rudder, according to an aspect.
Figure 11D:
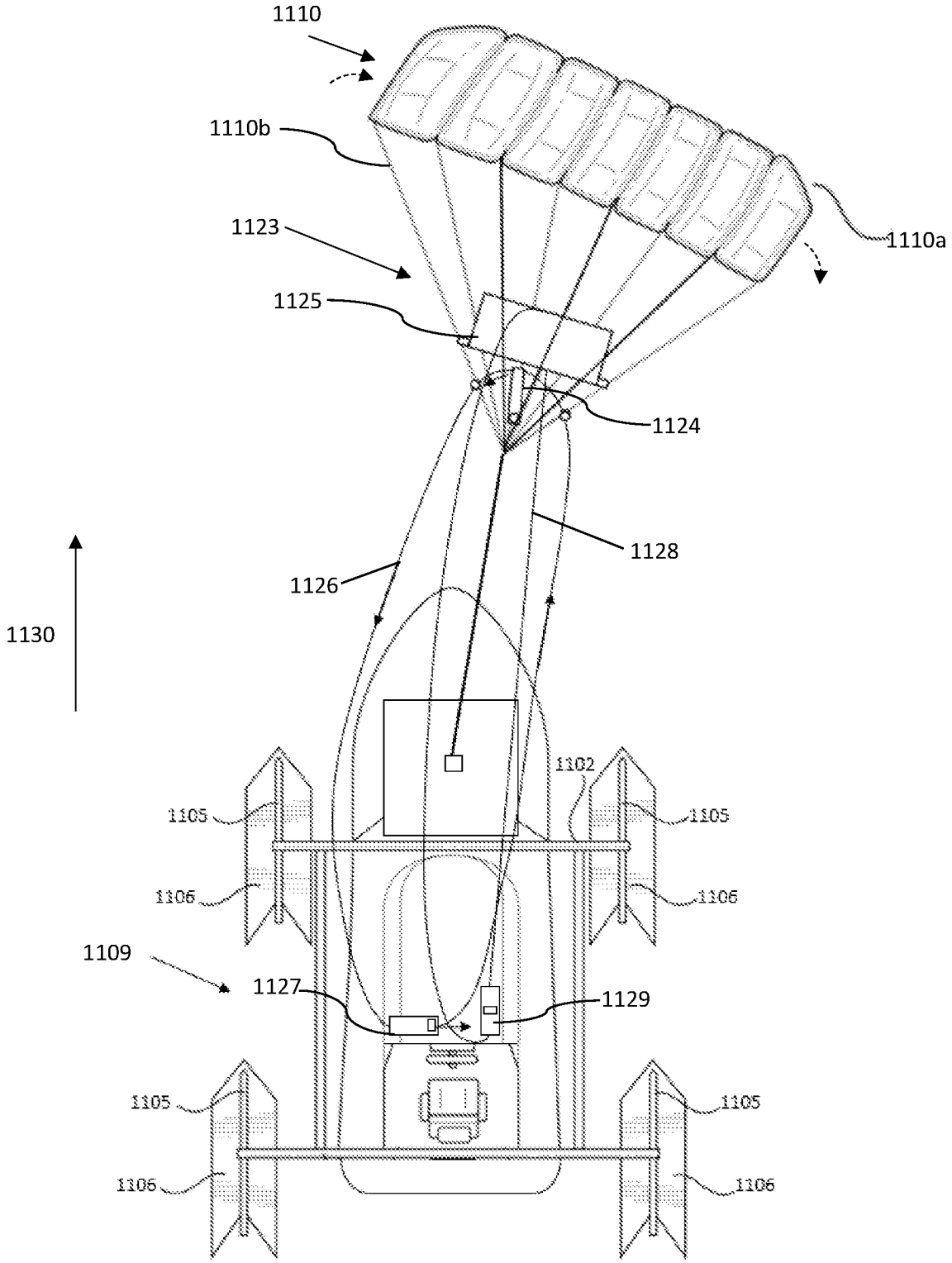

FIG. 11A-11B illustrates the side perspective view of a parasail 1110 having a parasail control rudder 1123, according to an aspect. FIG. 11C-11D illustrates the top perspective view of a parasail 1110 having a parasail control rudder 1123, according to an aspect. Similarly to parasail 910 of FIG. 9, a controllable parasail 1110 may be secured to a boat 1109 by a parasail mount 1111. The controllable parasail 1110 may utilize a parasail control rudder 1123 in order to allow a passenger on said boat 1109 to selectively manipulate the pitch angle and yaw angle of the attached parasail 1110.

Unlike conventional sails, such as those found on a sailboat, a parasail 1110 may not exert a significant roll directional force upon the attached boat 1109, even during turbulent wind conditions, thus preventing a rocking motion that may cause the boat 1109 to capsize. A parasail may be comprised of a parasail canopy 1110*a* secured to a plurality of parasail cords 1110*b*, as seen in FIG. 11A-11D. A controllable parasail 1110 may be secured to a boat 1109 using parasail cords 1110*b*, such that the parasail canopy 1110*a* is secured to the plurality of parasail cords 1110*b*, the plurality of parasail cords 1110*b* are secured a mount line 1111*a* and the mount line 1111*a* is secured to the parasail mount 1111 and thus the boat 1109. As is understood in the industry, in addition to providing a desired propulsive force to a boat 1109 for moving in an intended travel direction, a parasail 1110 may also apply a vertical force to said boat 1109, potentially lifting the boat 1109 partially out of the water. Such a vertical force, if not suitably compensated for, may cause an attached boat 1109 or vessel to lift uncontrollably out of the water and/or capsize. However, the disclosed wings 1106 of the boat stabilizer 1102 may be utilized to prevent the boat 1109 from lifting too far above the surface of the water. Through adjustment of the wing angles of the boat stabilizer 1102, as described hereinabove, this vertical force may be compensated for to prevent the vessel from rising too far out of the water and utilized to propel the boat 1109 forward with proper wing 1106 adjustment.

Due to the capability of wings 1106 of the boat stabilizer 1102 to be adjusted to compensate for and moderate an upward force applied on the boat 1109 by the disclosed controllable parasail 1110, the forward momentum provided by said parasail 1110 may be fully utilized by the attached boat 1100 without fear of the capsizing or being lifted uncontrollably out of the water. In order to optimize the balance of directional forces exerted on the boat 1109 by the parasail 1110, a parasail control rudder ("parasail rudder") 1123 may be utilized within the parasail assembly. The parasail control rudder 1123 may be comprised of two separate adjustment panels, a first adjustment panel ("first panel") 1124 and a second adjustment panel ("second panel") 1125, each of which is responsible for adjusting the parasail 1110 in a different direction. It should be understood that the first adjustment panel 1124 may be positioned closer to the boat 1109 than the second adjustment panel 1125 as seen in FIG. 11A-11D, or further from the boat than the second adjustment panel 1125, in an alternate embodiment.

Each panel may be suitably attached to two separate parasail cords 1110*b* by corresponding pivot screws, such as yaw pivot screws ("yaw screws") 1124*a* disposed on the first panel 1124 and pitch pivot screws ("pitch screws") 1125*a* disposed on the second panel 1125. The attachment of these pivot screws to corresponding parasail cords 1110*b* allows for the angle of each panel to be selectively adjusted by controllers 1127,1129, which will be discussed in greater detail hereinbelow. The yaw pivot screws 1124*a* may both be disposed on the yaw rotational axis ("yaw axis"), whereas the pitch pivot screws 1125*a* may both be disposed on the pitch rotational axis ("rotational axis"). As such, each panel, and thus the parasail control rudder 1123, may be pivotally secured to the parasail cords 1110*b*.

Through rotational adjustment of both the first adjustment panel 1124 and the second adjustment panel 1125, the parasail control rudder 1123 may be used to utilize high elevation wind 1130 in order to provide forward propulsion, the desired amount of vertical lift and additional steering capabilities to the attached boat 1109. When the parasail control rudder 1123 is used in conjunction disclosed wings 1106, the boat 1109 may achieve a desired balance of lift and forward propulsion, all while keeping the vessel stable and preventing capsizing. The panels of the parasail control rudder 1123 may be controlled using methods similar to the prior disclosed wings 1106 of the boat stabilizer, or comparable electronic methods known in the industry.

The disclosed parasail control rudder 1123 may be manipulated through mechanisms comparable to the cable pulley system 616*a* that is shown and described in FIG. 5A-6C. A passenger on the boat 1109 may control each panel of the parasail control rudder 1123 individually using a corresponding controller device 1127, 1129 similar to angle controller 613 of FIG. 5A. For example, yaw controller 1127 may be used to control the yaw angle of the first panel 1124 and a pitch controller 1129 may be used to control the pitch angle of the second panel 1125. Each yaw screw 1124*a* of the first adjustment panel 1124 may nested within a corresponding yaw screw port within a corresponding parasail cord 1110*b* to allow for yaw pivoting of the first panel 1124, while each pitch screw 1125*b* of the second adjustment panel 1125 may also be nested within a corresponding pitch screw port within to a corresponding parasail cord 1110*b* to allow for pitch pivoting of the second panel 1125. A tip end of the first adjustment panel 1124 may be secured to a yaw cable 1126, wherein said yaw cable 1126 is secured to a yaw controller 1127 on the boat 1109 or boat stabilizer 1102. A tip end of the second adjustment panel 1125 may be secured to a pitch cable 1128, wherein said pitch cable 1128 is secured a pitch controller 1129 on the boat 1109 or boat stabilizer 1102. The yaw cable 1126 may be continuous, wherein said yaw cable 1126 is nested within a tip end of the first panel 1124, while the pitch cable 1128 may also be continuous, wherein said pitch cable 1128 in nested within a tip end of the second panel 1125.

Each of the described controllers 1127, 1129 is configured to rotationally adjust a corresponding panel, thus enabling pitch or yaw adjustment of the controllable parasail canopy 1110*a*. For example, as can be seen in FIG. 11B, the adjustment of the pitch controller 1129 results in the manipulation of the secured pitch cable 1128, and thus pitch rotational movement of the second adjustment panel 1125 and pitch adjustment of the attached controllable parasail canopy 1110*a*. In another example, as can be seen in FIG. 11D, the adjustment of the yaw controller 1127 results in the manipulation of the secured yaw cable 1126, and thus yaw rotational movement of the first adjustment panel 1126 and yaw adjustment of the attached controllable parasail canopy 1110*a*.

In order to ensure proper rotational movement of each panel, their corresponding cables 1126, 1128 may also travel through cable slots 1110*e* in corresponding parasail cords 1110*b*. For example, the yaw cable 1126 may travel through cable slots in corresponding parasail cords, whereas the pitch cable 1128 may travel through cable slots in different corresponding parasail cords. By traveling through cable slots within the parasail cords, an optimal angle may be achieved between the attachment of a cable to its corresponding panel and the cable slot through which said cable travel, such that the adjustment of a cable from the controller may be done smoothly and evenly without undue force. During operation of the parasail 1110, the same tension provided by the wind that keeps the parasail cords 1110*b* taut may also be used to keep the yaw cable 1126 and pitch cable 1128 taut to ensure proper parasail control rudder 1123 functionality.

Each element of the controllable parasail may be made of a suitable material. The parasail canopy 1110*a* may be made of a lightweight plastic material that is sufficiently durable to endure strong winds without being damaged. The parasail cord 1110*b*, yaw cable 1126 and pitch cable 1128 may be made of a durable material such as metal or plastic having a suitable tensile strength to support their functions described herein. Each panel of the parasail control rudder 1123 may be made of a lightweight, but durable plastic or metal, in order to prevent deformation or damage that may occur due to exposure to high wind speeds. Each other element of the controllable parasail 11110 and boat stabilizer 1102 may be made of a suitably strong material, unless otherwise noted.

It should be noted that the yaw controller 1127 and the pitch controller 1129 may be positioned in a location that may be easily manipulated by a passenger on the boat 1109. The positioning of the pitch and yaw controllers in FIG. 11A-11B is simply to help identify the interconnections of each cord with its respective controllers. In a preferred embodiment, the pitch controller 1129 and yaw controller 1127 may be placed close to a driver seat 1131 in the boat 1109, such that an individual driving said boat 1109 will have easy access to said controllers, as seen in FIG. 11C-11D. The yaw cable 1126 and pitch cable 1128 may also be bundled into a shared housing to keep them neatly arranged, such as cable organizer housing 1335 of FIG. 13. Through individual adjustment of the described yaw controller 1127 and pitch controller 1129, along with proper manipulation of the hereinabove disclosed wings 1106 of the boat stabilizer 1102, the optimal balance of vertical lift and propulsive force may be produced from the incoming wind 1130, while simultaneously providing enhanced directional control to the attached vessel during travel. The yaw controller 1127 and pitch controller 1129 may be secured to the boat 1109, boat stabilizer 1102, the upper harness of the boat stabilizer, such as upper harness 204 or FIG. 2A, or any other suitable location in which a passenger may easily access.

Figure 12A:
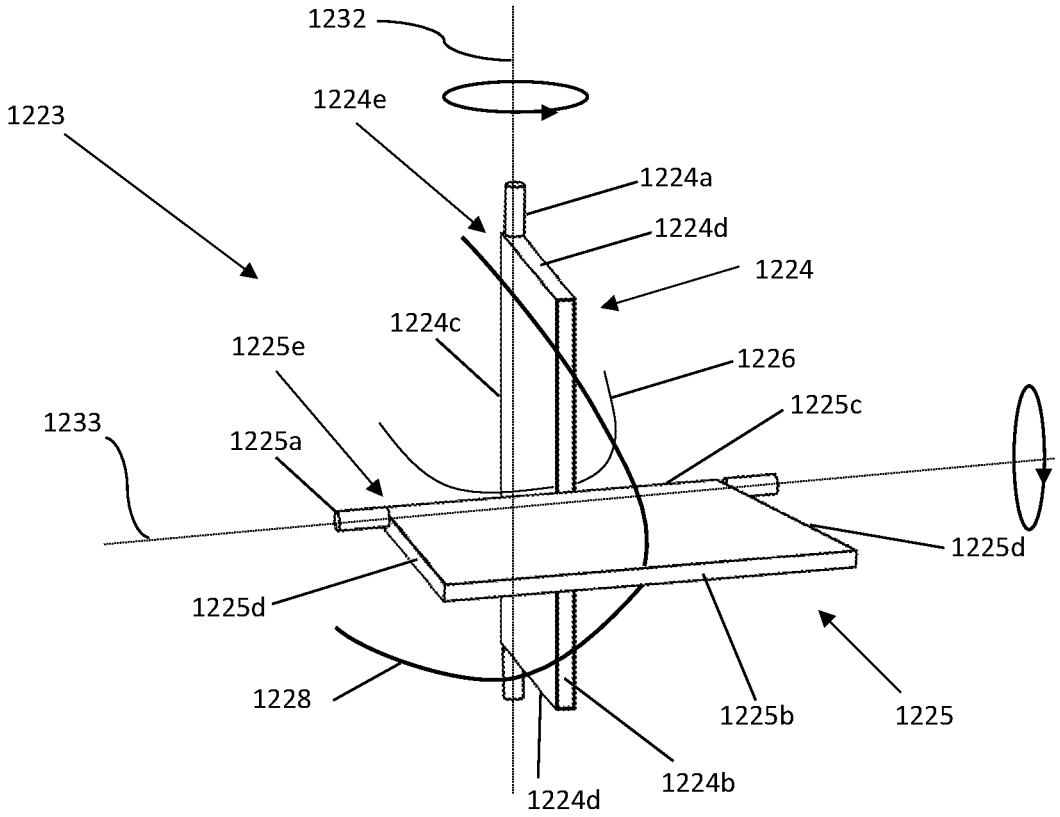
FIG. 12A illustrates the top perspective view of a parasail control rudder, according to an aspect.
Figure 12B:
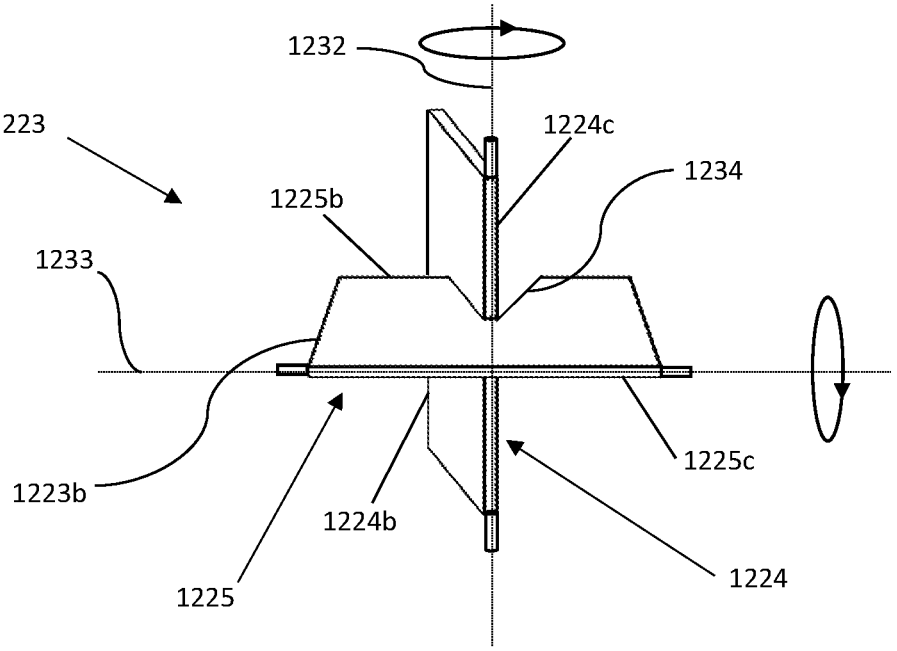
FIG. 12B illustrates the bottom perspective view of an alternative embodiment of a parasail control rudder, according to an aspect.

FIG. 12A illustrates the top perspective view of a parasail control rudder 1223, according to an aspect. FIG. 12B illustrates the bottom perspective view of an alternative embodiment of a parasail control rudder 1223, according to an aspect. As can be seen in FIGS. 12A and 12B, the first panel 1224 and second panel 1225 may be structurally similar to each other. The main difference between the two panels is that the first panel 1224 is configured to be rotated on a yaw rotational axis 1232 while the second panel 1225 is configured to be rotated on a pitch rotational axis 1233. The yaw rotational axis 1232 may be perpendicular to the pitch rotational axis 1233, such that the first panel 1224 and second panel 1225 are also perpendicular to each other while each is in a neutral position, as depicted in FIG. 12A.

The first adjustment panel 1224 of the parasail control rudder 1223 may be a flat rectangular plate having a tip end 1224*b*, a pivot end 1224*c*, two opposite side ends 1224*d* and rotation edge 1124*e* between each opposite side end 1224*d* and the pivot end 1224*c*, wherein the first panel 1124 is configured to adjust the yaw of the parasail (side-to-side motion), thus allowing the attached vessel to turn port or starboard more easily. The first panel 1124 may have a yaw pivot screw 1224*a* disposed on each opposite side end 1124*d* of said first panel 1224, such that each yaw pivot screw 1224*a* is disposed on a different corresponding rotation edge 1224*e*, wherein the yaw screws 1224*a* allow for selective pivoting of said first panel 1224 on the yaw axis 1232. A yaw cable 1226 may be nested within, or otherwise attached to, the tip end 1224*b* of the first panel 1224 to allow the yaw controller to selectively rotate the first panel 1224 on the yaw rotational axis 1232, as described hereinabove.

The second adjustment panel 1225 of the parasail control rudder 1223 may be also be a flat rectangular plate having a tip end 1225*b*, a pivot end 1225*c*, two opposite side ends 1225*d* and rotation edge 1125*e* between each opposite side end 1225*d* and the pivot end 1225*c*, wherein the second panel 1125 is configured to adjust the pitch of the parasail (up and down motion), thus allowing the attached vessel to adjust the balance between vertical lift and forward propulsion supplied by the parasail. The second panel 1125 may have a pitch pivot screw 1225*a* disposed on each opposite side end 1125*d* of said second panel 1225, such that each pitch pivot screw 1225*a* is disposed on a different corresponding rotation edge 1225*e*, wherein the pitch screws 1225*a* allow for selective pivoting of said second panel 1225 on the pitch axis 1233. A pitch cable 1228 may be nested within, or otherwise attached to, the tip end 1225*b* of the second panel 1225 to allow the pitch controller to selectively rotate the second panel 1225 on the pitch rotational axis 1233, as described hereinabove.

The second adjustment panel 1225 may be further comprised of a triangular notch 1234 on the tip end 1225*b* of the second panel 1225. This triangular notch 1234 may be used to seat the first panel 1224 such that the yaw rotational axis 1232 travels through said triangular notch 1234. By nesting or seating the first adjustment panel 1224 within the triangular notch 1234 of the second adjustment panel 1225, a sturdy parasail rudder 1223 configuration may be achieved, in which said parasail may greatly resist damage or deformation as a result of its exposure to high winds. Additionally, the shape and size of the triangular notch 1234 may limit the first panel's rotation range on the yaw rotational axis, allowing the triangular notch 1234 to be used to define the maximum operating angles for the first panel 1224 to prevent it from exceeding a desired yaw angle range.

It should be understood that the dimensions of each panel and the allowable pitch and yaw angles for each corresponding panel should be commensurate with the degree to which the parasail is meant to be adjusted. For example, by providing panels that both have small surface areas with regards to their faces that deflect the incoming wind, the extent to which each panel may influence the angle of the parasail canopy may be reduced, thus allowing for smaller, fine-tuned adjustments of the pitch and yaw angle to be made, rather than larger adjustment. Additional structures, such as the disclosed triangular notch 1234, may also be used to restrict the rotational capabilities of a panel, thus allowing it to remain within a desired operational angle range.

While both the first adjustment panel 1224 and the second adjustment panel 1225 are depicted as having their corresponding pivot ends closer to the boat than their corresponding tip ends, this may be reversed in an alternate configuration. In said alternate configuration, the pivot end 1224*c*, 1225*c* of each panel may be closer to the parasail canopy 1110*a*, while the tip end 1224*b*, 1225*b* of each panel is closer to the boat or vessel. This alternate configuration may allow each panel to be closer to a neutral, centered position during start up, as a result of gravity, rather than relying on tension established by the yaw cable and pitch cable during parasail operation to allow the panels of the parasail control rudder 1223 to assume said neutral, centered position. This alternate configuration may have a reduced maximum range of the rotation for each panel, as a result of the necessary adjustments made to the positions of the corresponding cord ports. For this reason, the disclosed embodiment of FIG. 11A-11D, may be the preferred embodiment, as a result its larger panel rotation range for each panel 1224,1225. The hereinabove described neutral, centered position may be depicted in FIG. 12A, wherein the second panel and the first panel are centered between angles consistent with their operational extremes (e.g., their maximum and minimum angles).

Additionally, while the second panel 1225 is depicted throughout the figures as being closer to the parasail canopy than the first panel 1224, the positioning of the first and second panels may be altered such that the first panel 1224 is closer to the parasail than the second panel 1225. A panel that is positioned closer to the boat may partially deflect some of the incoming wind, such as wind 1130 of FIG. 11A, away from the panel that is closer to the parasail canopy. For example, in FIG. 11A, the first panel 1124 may deflect some of the incoming wind 1130 away from the second panel 1125. For this reason, the panel corresponding to the directional control that is more sought after or important, whether that be the enhanced turning capabilities enabled by yaw rotational movement of the first panel 1224 or superior lift and forward propulsion balance enabled by pitch rotational movement of the second panel 1225, may be positioned closer to the attached boat (further from the parasail canopy) than the other panel. However, this deflection of the incoming wind off of the panel that is closer to the boat may not have a notable impact on the performance of the first panel 1224, second panel 1225 or the ability of the parasail controller rudder 1223 to suitably adjust the parasail, regardless of configuration.

Similarly to what was described for the wing pitch angle controllers, the pitch and yaw controllers may be completely manual and utilize no electronics, or may be integrated with electronic elements to enable easier adjustment of the corresponding panels. For example, one or more batteries may be connected to electric motors within the yaw controller and the pivot controller, wherein manipulating each controller results in adjustments being made to the corresponding cable, and thus the corresponding panel. Electric motors may be desirable for ease of use, but may require additional elements such as motors, batteries and wires, increasing device complexity.

Figure 13:
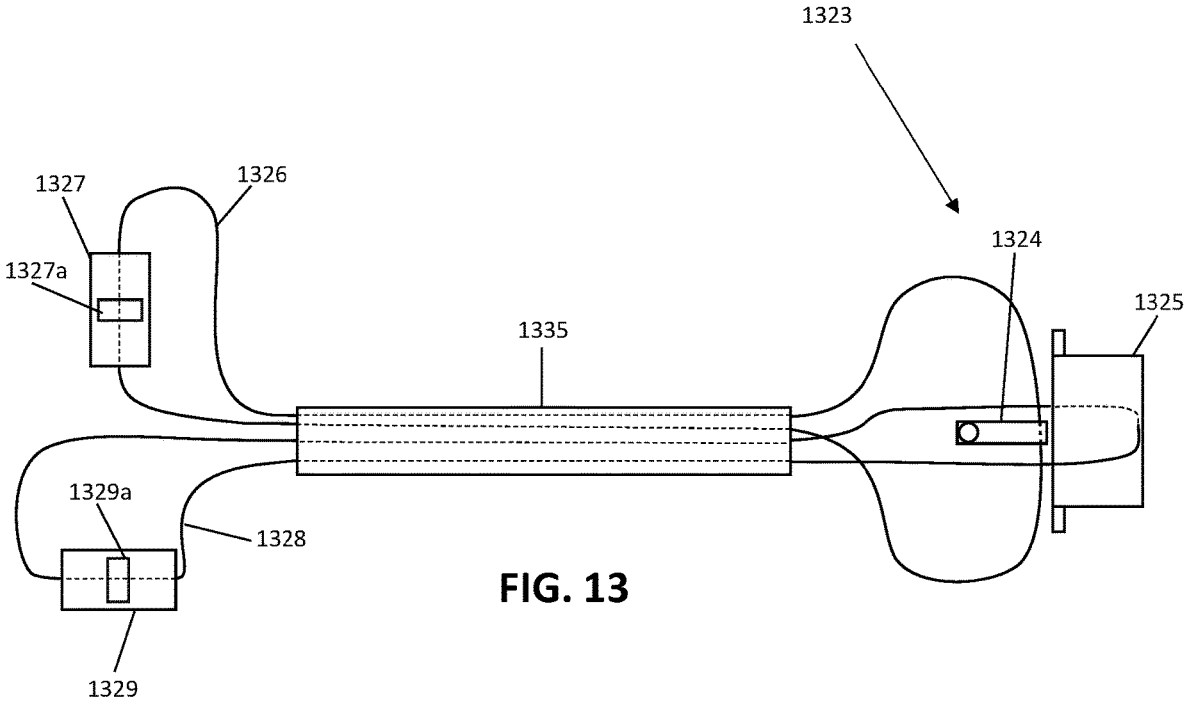
FIG. 13 illustrates the top perspective view of the yaw cable and pitch cable traveling through a cable housing, according to an aspect.

FIG. 13 illustrates the top perspective view of the yaw cable 1326 and pitch cable 1328 traveling through a cable organizer housing 1335, according to an aspect. In order to prevent the yaw cable 1326 and the pitch cable 1328 from interfering with other boat elements and each other, a central portion of both the yaw cable 1326 and the pitch cable 1328 may be housed within a cable organizer housing ("cable housing") 1335, such that each cable is partially housed the cable organizer housing 1335. This cable housing 1335 is configured to allow the cables to be rotated or otherwise manipulated as necessary to allow for proper panel manipulation while neatly organizing the cables and preventing said cables from rubbing against each other. Such a housing may be able to increase the longevity of each cable by preventing each cable from rubbing against itself, the other cable, or another boat element. This cable housing may be configured to attach to the parasail mount, such as parasail mount 1111 of FIG. 11, such that the cables are neatly organized as they travel from each controller 1327, 1329 to their respective panels 1324, 1325 within the parasail control rudder 1323. The cable organizer housing 1335 may be made of a suitably durable and lightweight material that does not damage the cables housed within it, such as a flexible plastic.

Each controller 1327, 1329 may be implemented with a handle 1327*a*, 1329*a* to allow for manual manipulation by a user. For example, the yaw controller 1327 may have a yaw handle 1327*a* for controlling the first adjustment panel 1324, while the pitch controller 1329 may have a pitch handle 1329*a* for controlling the second adjustment panel 1325. Sliding of each handle within the controller may result in the rotation of the attached cable, and thus panel rotation Comparable control elements such as switches, buttons or other known control elements may also be utilized as part of each controller to facilitate the adjustment of each panel as disclosed herein. Each controller 1327, 1329 may also appear and function similarly to wing pitch angle controller 613 of FIG. 6A.

Figure 14:
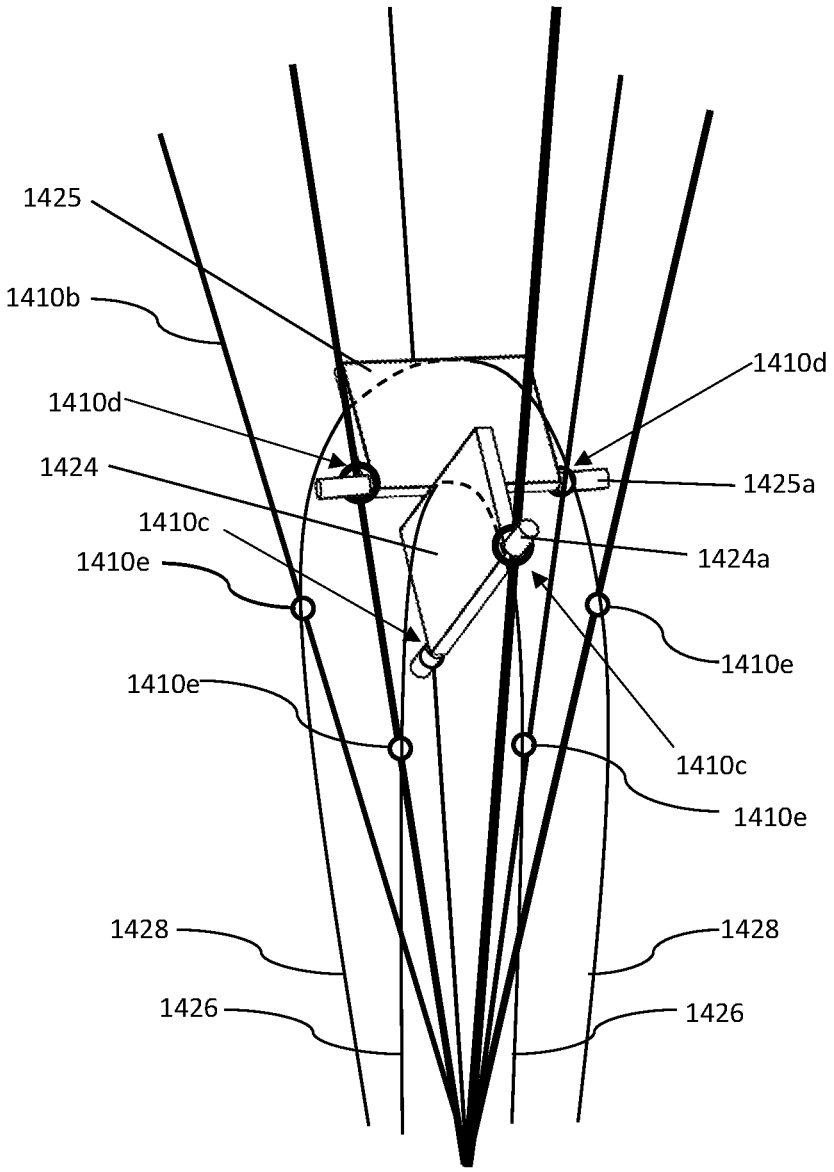
FIG. 14 illustrates the top perspective view of a parasail control rudder secured to parasail cords, according to an aspect.

FIG. 14 illustrates the top perspective view of a parasail control rudder 1423 secured to parasail cords 1410*b*, according to an aspect. As described hereinabove, each panel of the parasail control rudder 1423 may be suitably secured to two parasail cords 1410*b* in order to enable the required rotational movement. The yaw pivot screws 1424*a* of the first panel 1424 may each be secured or nested within a yaw screw port 1410*c*, wherein each yaw screw port 1410*c* is a through hole nested within a corresponding parasail cord 1410*b*. Similarly, the pitch pivot screws 1425*a* of the second panel 1425 may each be secured or nested within a pitch screw port 1410*d*, wherein each pitch screw ports 1410*d* is a through hole nested within a corresponding parasail cord 1410*b*. As such each pivot screw of each panel may be suitable nested within a corresponding screw port 1410*c*, 1410*d* in order to allow the panels to be rotated.

In addition to the yaw cable 1426 being secured to the tip end of the first panel 1424, the yaw cable 1426 may also travel through two cord ports 1410*e* in corresponding parasail cords 1410*b* in order to allow a suitable tension angle to be established between the first panel 1424 and each corresponding cord port 1410*e* to enable smooth rotation of the first panel. Also similarly, the pitch cable 1428, while being secured to the tip end of the second panel 1425, may travel through two cord ports 1410*e* in corresponding parasail cords 1410*b* in order to allow a suitable tension angle to be established between the first panel and each corresponding cord port 1410*e* to enable smooth rotation of the second panel 1425. The tension established by the parasail during operation may help to keep the yaw cable 1426 and the pitch cable 1428 taut and operational during parasail use.

It should be understood that each cable may be continuous as described hereinabove, wherein each continuous cable is nested within or secured to the tip end of a corresponding panel, or that each cable is broken up into separate segments, each of which attaches a corresponding face of each panel to a corresponding end of a controller to enable the same function. Additionally, each yaw screw port 1410*c*, pitch screw port 1410*d* and cord port 1410*e* may be disposed on, nested in or otherwise incorporated within any suitable position on any suitable parasail cord 1410*b* to achieve the desired rotational functionality of each panel disclosed herein. It should also be understood that the yaw screw ports 1410*c*, pitch screw ports 1410*d* and cord ports 1410*e* may not necessarily be to scale in FIG. 14, wherein the size of each port may appear enlarged to make their identification easier.

Figure 15:
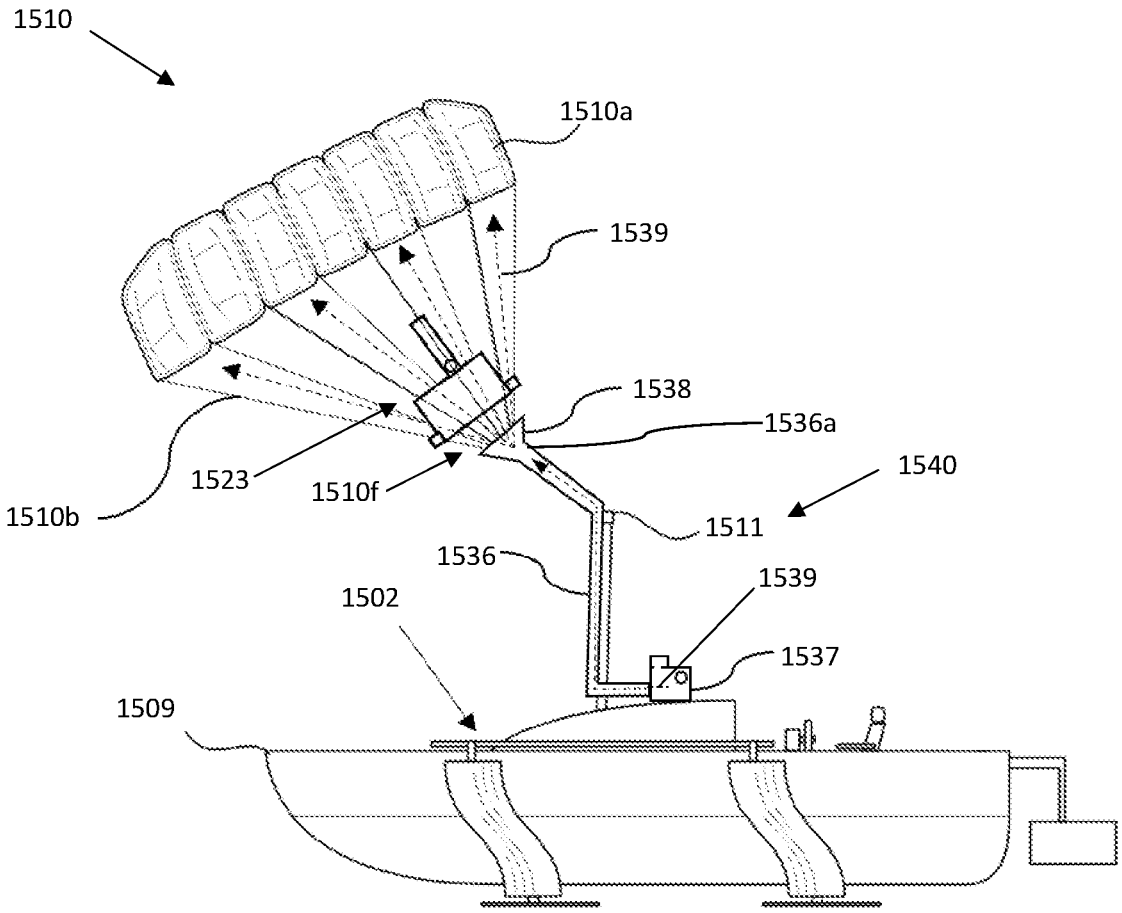
FIG. 15 illustrates the side perspective view of a boat having a parasail with a parasail deployer, according to an aspect.

FIG. 15 illustrates the side perspective view of a boat 1509 having a controllable parasail 1510 with a parasail deployer 1540, according to an aspect. In order to help initiate parasail 1510 function in low wind conditions, a starter compressor 1537 may be implemented alongside a starter hose 1536 as part of a parasail deployer 1540 assembly. Said starter compressor 1537 may be suitably secured to the boat 1509 or the boat stabilizer, and to a starter hose 1536, such that a starter air stream 1539 may be generated within the starter compressor 1537 and travel through the starter hose 1536 to flow into the parasail canopy 1510*a*. Said starter hose 1536 may be attached to the parasail mount 1511 and may be travel from the starter compressor 1537 to the parasail cords 1510*b*. The mount line, such as mount line 1111*a* of FIG. 11 may be housed within a top portion of the starter hose 1536. A spreader funnel 1538 may be disposed on an output end 1536*a* of the starter hose 1536, such that the starter air stream 1539 expands as it exits the larger end of the spreader funnel 1538 and is blown into the parasail canopy 1510*a*. This spreader funnel 1538 may surround a mounted portion 1510*f* of each parasail cord 1510*b* to ensure the spreader funnel 1538 remains suitably positioned on the parasail assembly to direct the outgoing starter air stream 1539 into the parasail canopy 1510*a*. The combination of the starter hose 1536, starter compressor 1537 and the spreader funnel may be referred to as a parasail deployer 1540. The starter hose 1536 should be sufficiently flexible that it may flex accordingly to conform the positioning and angle of the parasail 1510, and may be made of a suitable lightweight, durable materials such as plastic. The spreader funnel 1538 may also be made out of lightweight, durable plastic material.

This expansion of the starter air stream 1539 as it exits the larger end of the spreader funnel 1538 allows said starter air stream 1539 to inflate and lift the parasail canopy 1510*a* into the air so that it may being to utilize high elevation air streams to being propelling the attached boat 1509. Such a starter compressor 1537 may utilize a power source known in the industry, such as gasoline, batteries, etc. The starter hose 1536 may also surround the entirety of the parasail mount 1511, such that parasail mount 1511 is fully nested within and surrounded by the starter hose 1536, in order to provide a secure attachment of the starter hose 1536 to said parasail mount 1511, as long as the presence of the parasail mount 1511 within the starter hose 1536 does not adversely affect device efficacy or performance. This starter compressor 1537 and the starter hose 1536 with the spreader funnel may also be utilized with a standard, non-controllable parasail, to initiate parasail lift as disclosed herein.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

The term "bird shape" used within this application is defined as an arrowhead shape with an additional point at its rear, pointing opposite from the forward-facing tip, and disposed between and aligning with the two back facing points. Nautical terminology used within this application is understood to retain its known meanings including "bow" referring to the front of the vessel, "stern" referring to the back of the vessel, "port" referring to the left of the vessel and "starboard" referring to the right of the vessel.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

Claim limitations should be construed as means-plus-function limitations only if the claim recites the term "means" in association with a recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A boat stabilizer comprising: an upper harness having:
a body and;
an assembly control system having two wing angle controllers and four orientation locks;
four wing assemblies attached to the body, each wing assembly comprising:
a wing secured to a corresponding wing angle controller;
a wing mount attached to the wing and a corresponding orientation lock, wherein the assembly control system is configured to adjust a pitch angle of each of the wings and to rotate each of the wing assemblies in and out of water; and
a controllable parasail comprising:
a parasail canopy;
a plurality of parasail cords secured to the parasail canopy;
a mount line secured to the plurality of parasail cords;
a parasail mount secured to the mount line and the upper harness;
a parasail control rudder pivotally secured to the parasail cords, the parasail control rudder comprising:
a first adjustment panel having a tip end, a pivoting end, two opposite side ends and a yaw pivot screw attached to each opposite side end, wherein each yaw pivot screw is configured to be nested within a yaw screw port within a corresponding parasail cord and the first adjustment panel is configured to be rotated on a yaw rotational axis;
a second adjustment panel having a tip end, a pivoting end, two opposite side ends and a pitch pivot screw attached to each opposite side end, wherein each pitch pivot screw is configured to be nested within a pitch screw port in a corresponding parasail cord and the second adjustment panel is configured to be rotated on a pitch rotational axis;
wherein the pitch rotational axis and yaw rotational axis are perpendicular to each other;
a yaw controller secured to the upper harness;
a pitch controller secured to the upper harness;
a yaw cable secured to the yaw controller and the tip end of the first adjustment panel, wherein the yaw cable is nested within cable slots within corresponding parasail cords and the yaw controller is configured to adjust the yaw cable to selectively rotate the first adjustment panel on the yaw rotational axis; and
a pitch cable secured to the pitch controller and the tip end of the second adjustment panel, wherein the pitch cable is nested within cable slots within corresponding parasail cords and the pitch controller is configured to adjust the pitch cable to selectively rotate the second adjustment panel on the pitch rotational axis.

2. The boat stabilizer of claim 1, further comprising a parasail deployer having a starter compressor, a starter hose secured to the starter compressor and a spreader funnel secured to the starter hose, wherein the starter hose is configured to surround the mount line, the spreader funnel is configured to surround a mounted portion of each parasail cord and the starter compressor is configured to generate a starter air stream that travels through the starter tube and expand as it exits the spreader funnel, such that the starter air stream inflates and elevates the parasail canopy.

3. The boat stabilizer of claim 1, wherein the yaw cable and pitch cable are partially housed within a cable organizer housing.

4. The boat stabilizer of claim 1, wherein each yaw pivot screw is disposed on a corresponding rotation edge of the first adjustment panel and each pitch pivot screw is disposed on a corresponding rotation edge of the second adjustment panel.

5. The boat stabilizer of claim 1, wherein the tip end of the first adjustment panel is closer to the parasail canopy than the pivot end of the first adjustment panel.

6. The boat stabilizer of claim 1, wherein the tip end of the second adjustment panel is closer to the parasail canopy than the pivot end of the second adjustment panel.

7. The boat stabilizer of claim 1, further comprising a triangular notch on the tip end of the second adjustment panel.

8. The boat stabilizer of claim 7, wherein the pivot end of the first adjustment panel is configured to be seated within the triangular notch on the tip end of second adjustment panel.

9. The boat stabilizer of claim 8, wherein a rotation range of the first adjustment panel is limited as a result of seating of the first adjustment panel within the triangular notch.

10. A boat stabilizer comprising: an upper harness having:
a body and;
an assembly control system having a plurality of wing angle controllers and a plurality orientation locks;
four wing assemblies attached to the body, each wing assembly comprising:
a wing secured to a corresponding wing angle controller and a corresponding orientation lock;
a controllable parasail comprising:
a parasail canopy;
a plurality of parasail cords secured to the parasail canopy;
a parasail mount secured to the plurality of parasail cords and the upper harness;
a parasail control rudder pivotally secured to the parasail cords, the parasail control rudder comprising:
a first adjustment panel configured to be rotated on a yaw rotational axis;
a second adjustment panel configured to be rotated on a pitch rotational axis, wherein the pitch rotational axis and yaw rotational axis are perpendicular to each other;
a yaw controller secured to the upper harness;
a pitch controller secured to the upper harness;
a yaw cable secured to the yaw controller and the first adjustment panel, wherein the yaw controller is configured to adjust the yaw cable to selectively rotate the first adjustment panel on the yaw rotational axis; and
a pitch cable secured to the pitch controller and the second adjustment panel, wherein the pitch controller is configured to adjust the pitch cable to selectively rotate the second adjustment panel on the pitch rotational axis.

11. The boat stabilizer of claim 10, further comprising a parasail deployer having a starter compressor, a starter hose secured to the starter compressor and a spreader funnel secured to the starter hose, wherein the spreader funnel is configured to surround a mounted portion of each parasail cord and the starter compressor is configured to generate a starter air stream that travels through the starter tube and expand as it exits the spreader funnel, such that the starter air stream inflates and elevates the parasail canopy.

12. The boat stabilizer of claim 10, wherein a lift force exerted by the controllable parasail on a boat attached to the boat stabilizer is moderated through selective adjustment of the wings and the parasail control rudder.

13. The boat stabilizer of claim 10, wherein the yaw controller is configured to provide directional control to an attached boat.

14. The boat stabilizer of claim 10, wherein the pitch controller is configured to selectively adjust the balance of vertical lift and forward propulsion exerted by the controllable parasail on an attached boat.

15. The boat stabilizer of claim 10, wherein the first adjustment panel is further from the parasail canopy than the second adjustment panel.

16. A boat stabilizer comprising: an upper harness having:

a body;

a plurality of wing angle controllers; and a plurality of orientation locks;

four wing assemblies attached to the body, each wing assembly comprising:

a wing secured to a corresponding wing angle controller and a corresponding one of the orientation locks; and a controllable parasail having:

a parasail canopy;

a plurality of parasail cords secured to the parasail canopy;

a parasail mount secured to the plurality of parasail cords, wherein the parasail mount is configured to attach to a boat;

a parasail control rudder pivotally secured to the parasail cords, the parasail control rudder comprising:

a first adjustment panel configured to rotate on a yaw rotational axis;

a second adjustment panel configured to rotate on a pitch rotational axis;

a yaw controller;

a pitch controller;

a yaw cable secured to the yaw controller and the first adjustment panel, wherein the yaw controller is configured to adjust the yaw cable to selectively rotate the first adjustment panel on the yaw rotational axis; and a pitch cable secured to the pitch controller and the second adjustment panel, wherein the pitch controller is configured to adjust the pitch cable to selectively rotate the second adjustment panel on the pitch rotational axis.

17. The boat stabilizer of claim 16, further comprising a parasail deployer having a starter compressor, a starter hose secured to the starter compressor and a spreader funnel secured to the starter hose, wherein the spreader funnel is configured to surround a mounted portion of each parasail cord and the starter compressor is configured to generate a starter air stream that travels through the starter tube and expand as it exits the spreader funnel, such that the starter air stream inflates and elevates the parasail canopy.

18. The boat stabilizer of claim 16, wherein the yaw cable and pitch cable are partially housed within a cable organizer housing.

19. The boat stabilizer of claim 16, wherein the yaw controller and the pitch controller do not utilize any electronic elements.

20. The boat stabilizer of claim 16, wherein the pitch and yaw controllers are configured to manipulate the parasail canopy to provide the desired balance of vertical lift and forward propulsion to an attached boat, as well as directional control to the attached boat.

* * * * *